US007612275B2

(12) United States Patent
Seppänen et al.

(10) Patent No.: US 7,612,275 B2
(45) Date of Patent: Nov. 3, 2009

(54) METHOD, APPARATUS AND COMPUTER PROGRAM PRODUCT FOR PROVIDING RHYTHM INFORMATION FROM AN AUDIO SIGNAL

(75) Inventors: Jarno Seppänen, Helsinki (FI); Antti Eronen, Tampere (FI); Jarmo Hiipakka, Espoo (FI)

(73) Assignee: Nokia Corporation, Espoo (FI)

( * ) Notice: Subject to any disclaimer, the term of this patent is extended or adjusted under 35 U.S.C. 154(b) by 325 days.

(21) Appl. No.: 11/405,890

(22) Filed: Apr. 18, 2006

(65) Prior Publication Data

US 2007/0240558 A1 Oct. 18, 2007

(51) Int. Cl.
*G10H 1/00* (2006.01)

(52) U.S. Cl. ..... 84/600; 84/611; 84/651

(58) Field of Classification Search ..... 84/600–609, 84/611, 635, 651, 667; 700/94
See application file for complete search history.

(56) References Cited

U.S. PATENT DOCUMENTS

| | | | | |
|---|---|---|---|---|
| 5,848,193 | A * | 12/1998 | Garcia | 382/232 |
| 6,871,180 | B1 * | 3/2005 | Neuhauser et al. | 704/500 |
| 7,301,092 | B1 * | 11/2007 | McNally et al. | 84/612 |
| 2002/0178012 | A1 * | 11/2002 | Wang et al. | 704/503 |
| 2003/0005816 | A1 * | 1/2003 | Stuebner et al. | 84/738 |
| 2003/0187894 | A1 * | 10/2003 | Wang | 708/313 |
| 2005/0217462 | A1 * | 10/2005 | Thomson et al. | 84/612 |
| 2006/0155399 | A1 * | 7/2006 | Ward | 700/94 |
| 2006/0266200 | A1 * | 11/2006 | Goodwin | 84/611 |
| 2007/0067162 | A1 * | 3/2007 | Villemoes et al. | 704/206 |
| 2007/0100606 | A1 * | 5/2007 | Rogers | 704/205 |
| 2007/0155312 | A1 * | 7/2007 | Goldberg et al. | 455/3.06 |
| 2007/0155313 | A1 * | 7/2007 | Goldberg et al. | 455/3.06 |
| 2007/0240558 | A1 * | 10/2007 | Seppanen et al. | 84/636 |
| 2008/0300702 | A1 * | 12/2008 | Gomez et al. | 700/94 |

FOREIGN PATENT DOCUMENTS

WO WO 2005/036396 4/2005

OTHER PUBLICATIONS

Anssi P. Klapuri, Antti J. Eronen and Jaakko T. Astola; Analysis of the Meter of Acoustic Musical Signals; IEEE Transactions on Audio, Speech, and Language Processing; Jan. 2006; vol. 14, No. 1.

Jeffrey Adam Bilmes; Timing is of the Essence: Perceptual and Computational Techniques for Representing, Learning, and Reproducing Expressive Timing in Percussive Rhythm; Submitted to the program in Media Arts and Sciences, School of Architecture and Planning, Massachusetts Institute of Technology; Sep. 1993.

(Continued)

*Primary Examiner*—David S. Warren
(74) *Attorney, Agent, or Firm*—Alston & Bird LLP

(57) ABSTRACT

An apparatus for providing a beat and tatum tracker includes an accent filter bank, a periodicity estimator, a period estimator and a phase estimator. The accent filter bank is configured to downsample an input audio signal. The periodicity estimator is configured to determine a periodicity based on the downsampled signal. The period estimator is configured to determine a period based on the periodicity. The phase estimator is configured to estimate a phase based on the period for determining beat and tatum times of the input audio signal.

36 Claims, 16 Drawing Sheets

OTHER PUBLICATIONS

Masataka Goto and Yoichi Muraoka; A Beat Tracking system for Acoustic Signals of Music; School of Science and Engineering, Waseda University; pp. 365-372.

Eric D. Scheirer; Tempo and Beat Analysis of Acoustic Musical Signals; Sep. 15, 1997; pp. 588-601; Machine Listing Group, MIT Media Laboratory, Cambridge, Massachusetts.

Jarno Seppanen; Tatum Grid Analysis of Musical Signals; IEEE Workshop on Applications of Signal Processing to Audio and Acoustics 2001; pp. W2001-W2001-4; Nokia Research Center, Tampere, Finland.

Jarno Seppanen; Computational Models of Musical Meter Recognition; Master of Science Thesis, Tampere University of Technology; Aug. 22, 2001.

Kristoffer Jensen and Tue Haste Andersen; Beat Estimation on the Beat; 2003 IEEE Workshop on Applications of Signal Processing to Audio Acoustics; Oct. 19-22, 2003; New Paltz, New York.

Christian Uhle and Juergen Herre; Estimation of Tempo, Micro Time and Time Signature from Percussive Music; Proc. Of the 6$^{th}$ Int. Conference on Digital Audio Effects (DAFX-03); Sep. 8-11, 2003; pp. DAFX-1-DAFX-6; London, UK.

Christian Uhle, Jan Rohden, Markus Cremer and Juergen Herre; Low Complexity Musical Meter Estimation from Polyphonic Music; AES International Conference; Jun. 17-19, 2004; pp. 1-6; London, UK.

Christian Uhle; Tempo Induction by Investigating the Metrical Structure of Music Using a Periodicity Signal that Relates to the Tatum Period; Fraunhofer Institute for Digital Media Technology.

William A. Sethares; Beat Tracking of Musical Performances Using Low-Level Audio Features; IEEE Transactions on Speech and Audio Processing; Mar. 2005; vol. 13, No. 2.

Matthew E. P. Davies, Paul M. Brossier and Mark D. Plumbley; Beat Tracking Towards Automatic Musical Accompaniment; Audio Engineering Society, Convention Paper 6408; May 28-31, 2005; pp. 1-7; Barcelona, Spain.

M.E.P. Davies and M.D. Plumbley; Beat Tracking with a Two State Model; pp. III-241-III-244; Queen Mary, University of London.

Masataka Goto and Yoichi Muraoka; A Beat Tracking system for Acoustic Signals of Music; School of Science and Engineering, Waseda University; pp. 365-375, Oct. 1994.

Jarno Seppanen; Tatum Grid Analysis of Musical Signals; IEEE Workshop on Applications of Signal Processing to Audio and Acoustics 2001; pp. W2001-W2001-4; Nokia Research Center, Tampere, Finland, Oct. 21-24, 2001.

M.E.P. Davies and M.D. Plumbley; Beat Tracking with a Two State Model; pp. III-241-III-244; Queen Mary, University of London, 2005.

* cited by examiner

METHOD, APPARATUS AND COMPUTER PROGRAM PRODUCT FOR PROVIDING RHYTHM INFORMATION FROM AN AUDIO SIGNAL

TECHNOLOGICAL FIELD

Embodiments of the present invention relate generally to music applications, devices, and services, and, more particularly, relate to a method, apparatus, and computer program product for providing rhythm information from an audio signal for use with music applications, devices, and services.

BACKGROUND

The modern communications era has brought about a tremendous expansion of wireline and wireless networks. Computer networks, television networks, and telephony networks are experiencing an unprecedented technological expansion, fueled by consumer demand. Wireless and mobile networking technologies have addressed related consumer demands, while providing more flexibility and immediacy of information transfer.

Current and future networking technologies continue to facilitate ease of information transfer and convenience to users. One area in which there is a demand to increase ease of information transfer relates to the delivery of services to a user of a mobile terminal. The services may be in the form of a particular media or communication application desired by the user, such as a music player, a game player, an electronic book, short messages, email, etc. The services may also be in the form of interactive applications in which the user may respond to a network device in order to perform a task or achieve a goal. The services may be provided from a network server or other network device, or even from the mobile terminal such as, for example, a mobile telephone, a mobile television, a mobile gaming system, etc.

In music applications, extraction of beat information can be of fundamental importance. Beat is an important rhythmic property common to all music. The sensation of beat is a fundamental enabler for dancing and enjoying music in general. Detecting beats in music enables applications to calculate musical tempo in units of beats per minute (BPM) for a particular piece of music. Meanwhile tatum, which is a term that is short for "temporal atom", is the shortest durational value repeatedly present in a music signal. The beat and the tatum are two examples of metrical levels found in music, and in any given piece of music there are multiple nested levels of metrical structure, or meter, present. The tatum is the lowest metrical level, the root from which all other metrical levels can be derived, while the beat is the most salient level. Since the concept of musical beat is universal, any device or application capable of extracting beat and tatum information from music would have wide appeal and utility. For example, such a device or application would be useful in music applications such as music playback, music remixing, music visualization, music synchronization, music classification, music browsing, music searching and numerous others.

Because of the recognized utility of beat detection, many proposals have been made which are directed to enabling beat detection. However, beat tracking from sampled audio is a nontrivial problem. An example of a conventional beat detection approach includes bandfiltering the lowest frequencies in a music signal and then, for example, calculating an autocorrelation of the extracted bass band. Unfortunately this and other conventional techniques do not give satisfactory results.

Accordingly, there is a need for a novel beat tracking algorithm that provides improved beat tracking capability.

Furthermore, such an improved beat tracker should be employable in mobile environments since it is increasingly common for music applications to be utilized in conjunction with mobile devices such as mobile telephones, mobile computers, MP3 players, and numerous other mobile terminals.

BRIEF SUMMARY

A method, apparatus and computer program product are therefore provided for rhythm analysis such as beat and tatum analysis from music. In particular, a method, apparatus and computer program product are provided that employ periodicity estimation using discrete cosine transform (DCT) or chirp z-transform (CZT), audio preprocessing using a decimating sub-band filterbank such as a quadrature mirror filter (QMF), and use of conditional comb filtering to refine beat period estimates. Accordingly, beat and tatum may be tracked for utilization in music applications. For example, exemplary embodiments of a beat and tatum tracker may be utilized in conjunction with mobile devices such as mobile telephones, mobile computers, MP3 players, and numerous other devices such as personal computers, game consoles, set-top-boxes, personal video recorders, web servers, home appliances, etc. Furthermore, exemplary embodiments of a beat and tatum tracker may be employable in services or server environments, since music is often available in computerized databases or web services. As such, the beat and tatum tracker may be employed for use with any known user interaction technique such as, for example, graphics, flashing lights, sounds, tactile feedback, etc. Additionally, beat and tatum information may be communicated to users of devices employing the beat and tatum tracker. As such, it may be possible, for example, to synchronize beats in two songs for seamless mixing.

In one exemplary embodiment, a method of providing a beat and tatum tracker is provided. The method includes employing downsampling to preprocess an input audio signal, determining periodicity and one or more metrical periods based on the downsampled signal, and performing phase estimation based on the periods.

In another exemplary embodiment, a computer program product for providing a beat and tatum tracker is provided. The computer program product includes at least one computer-readable storage medium having computer-readable program code portions stored therein. The computer-readable program code portions include first, second and third executable portions. The first executable portion is for employing downsampling to preprocess an input audio signal. The second executable portion is for determining periodicity and one or more metrical periods based on the downsampled signal. The third executable portion is for performing phase estimation based on the periods.

In another exemplary embodiment, an apparatus for providing a beat and tatum tracker is provided. The apparatus includes an accent filter bank, a periodicity estimator, a period estimator and a phase estimator. The accent filter bank is configured to downsample an input audio signal. The periodicity estimator is configured to determine periodicity based on the downsampled signal. The period estimator is configured to determine one or more metrical periods based on the periodicity. The phase estimator is configured to estimate a phase based on the period for determining beat and tatum times of the input audio signal.

In another exemplary embodiment, an apparatus for providing a beat and tatum tracker is provided. The apparatus includes means for employing downsampling to preprocess an input audio signal, means for determining a periodicity and period based on the downsampled signal, and means for performing a phase estimation based on the period.

Embodiments of the invention may provide a method, apparatus and computer program product for advantageous employment in music applications, such as on a mobile terminal capable of executing music applications. As a result, for example, music applications, devices, or services for performing functions such as music playback, music commerce, music remixing, music visualization, music synchronization, music classification, music browsing, music searching and numerous others may have improved beat and tatum tracking capabilities.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

FIG. 12(*b*) illustrates a power signal according to an exemplary embodiment of the present invention;

FIG. 12(*c*) illustrates excerpts of an accent signal according to an exemplary embodiment of the present invention;

Figure 16:
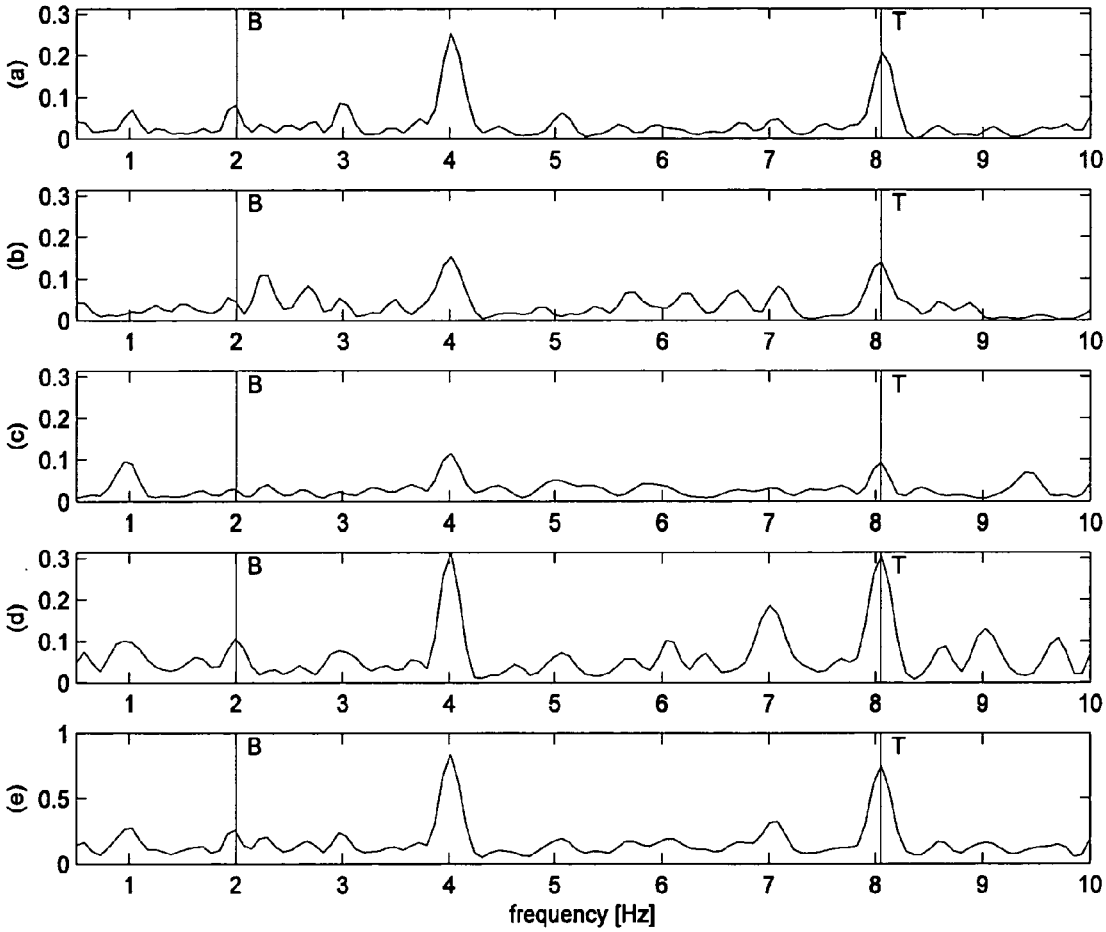
Figure 17:
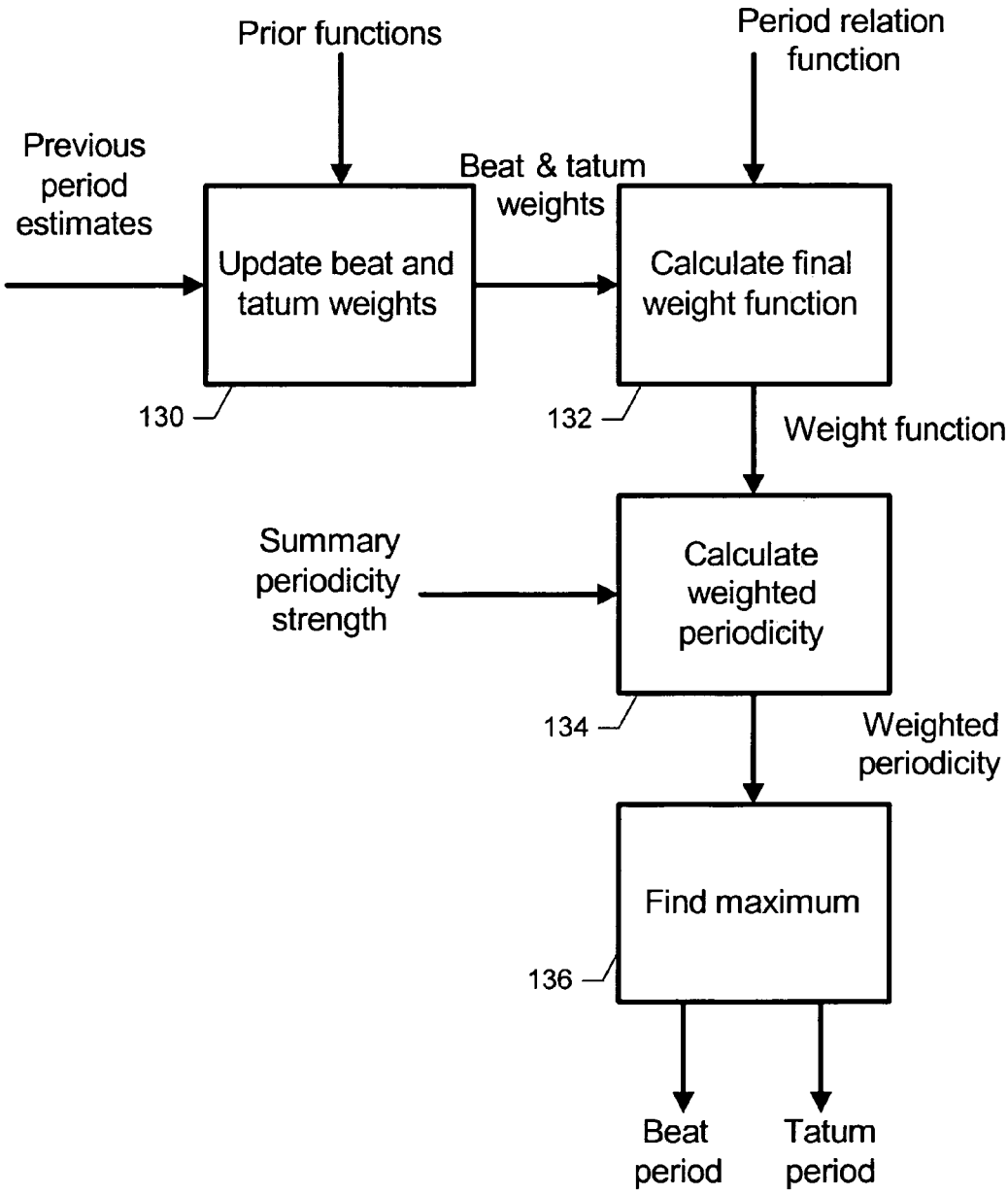
Figure 18:
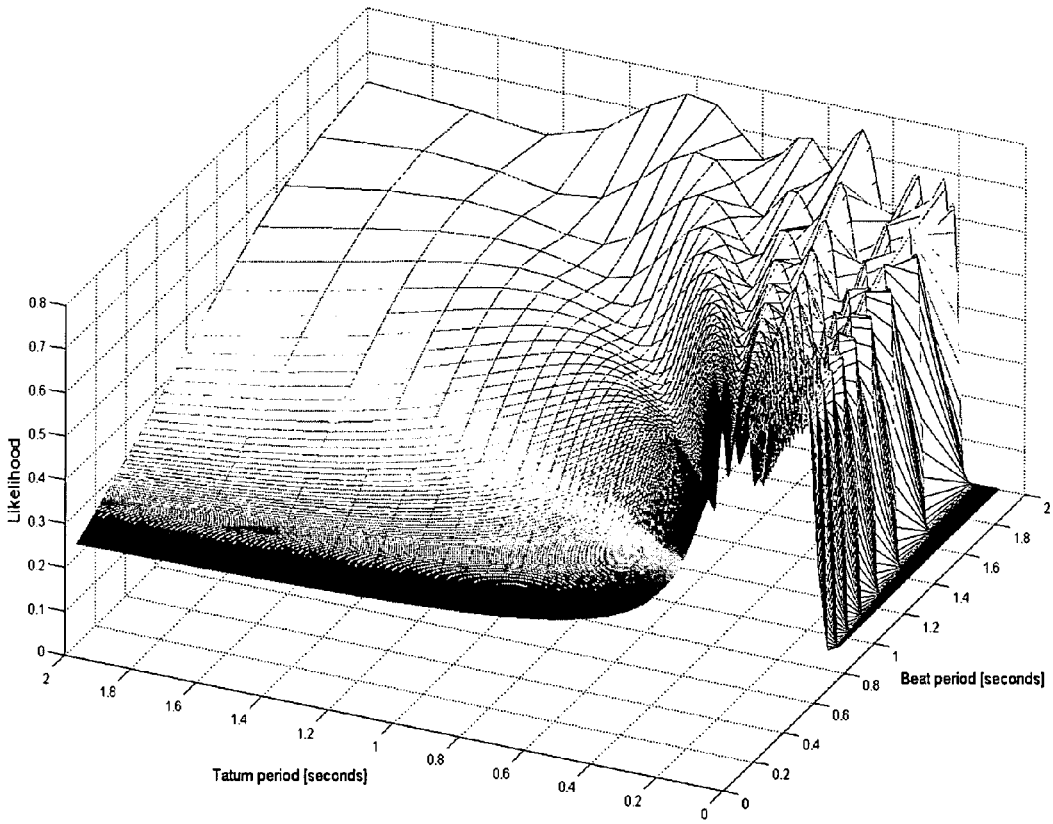
Figure 19:
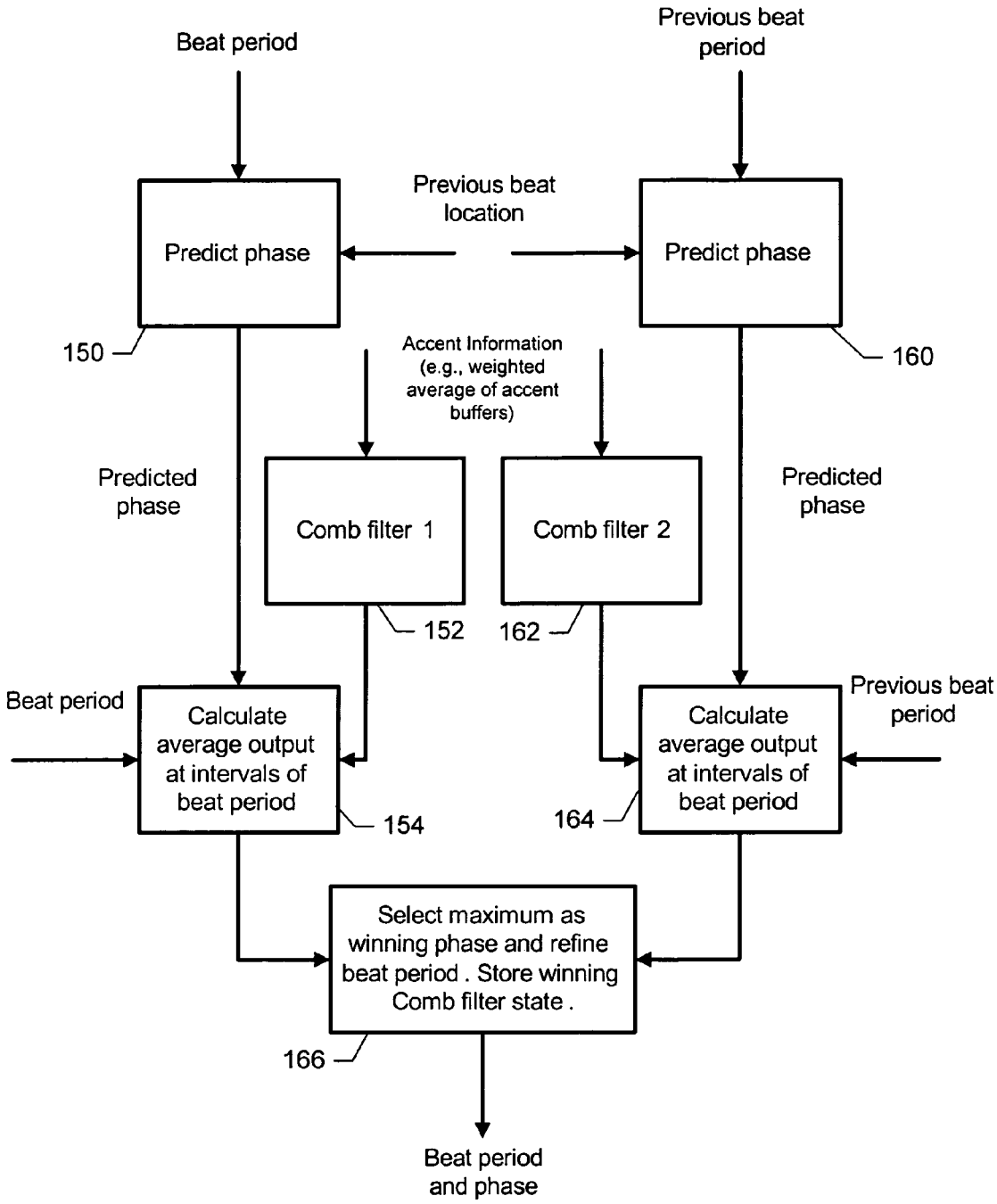
Figure 20:
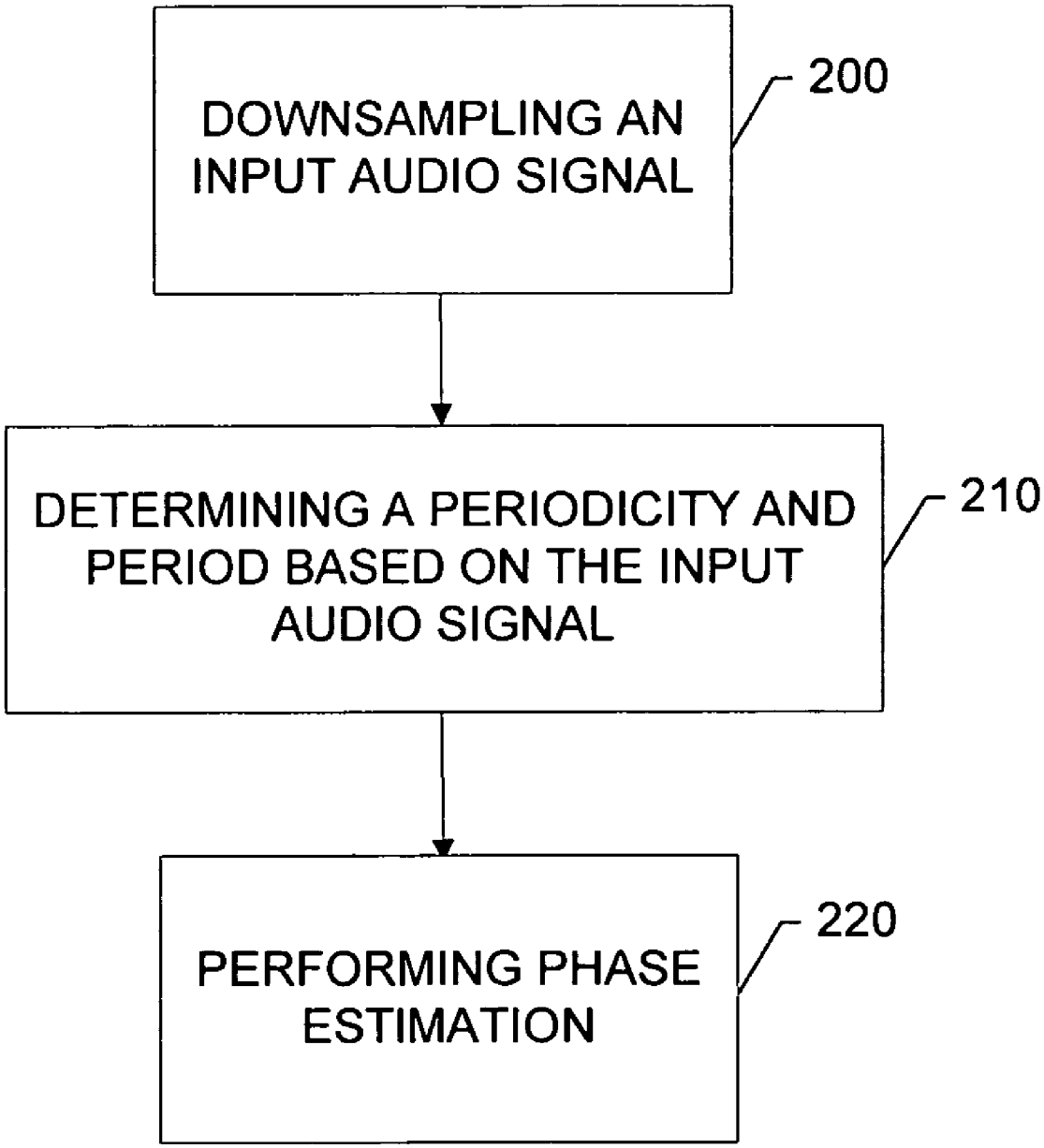

FIGS. 16(*a*), 16(*b*), 16(*c*) and 16(*d*) illustrate example sub-band periodicity buffers with superimposed beat frequency B and tatum frequency T according to an exemplary embodiment of the present invention;

FIG. 16(*e*) illustrates a summary periodicity buffer with superimposed beat frequency B and tatum frequency T according to an exemplary embodiment of the present invention;

FIG. 17 is a flowchart illustrating a period estimation according to an exemplary embodiment of the present invention;

FIG. 18 is a graph displaying a likelihood surface according to an exemplary embodiment of the present invention;

FIG. 19 is a flowchart illustrating a phase estimation according to an exemplary embodiment of the present invention; and FIG. 20 is a flowchart according to an exemplary method for providing beat and tatum times according to an exemplary embodiment of the present invention.

DETAILED DESCRIPTION

Embodiments of the present invention will now be described more fully hereinafter with reference to the accompanying drawings, in which some, but not all embodiments of the invention are shown. Indeed, embodiments of the invention may be embodied in many different forms and should not be construed as limited to the embodiments set forth herein; rather, these embodiments are provided so that this disclosure will satisfy applicable legal requirements. Like reference numerals refer to like elements throughout.

Figure 1:
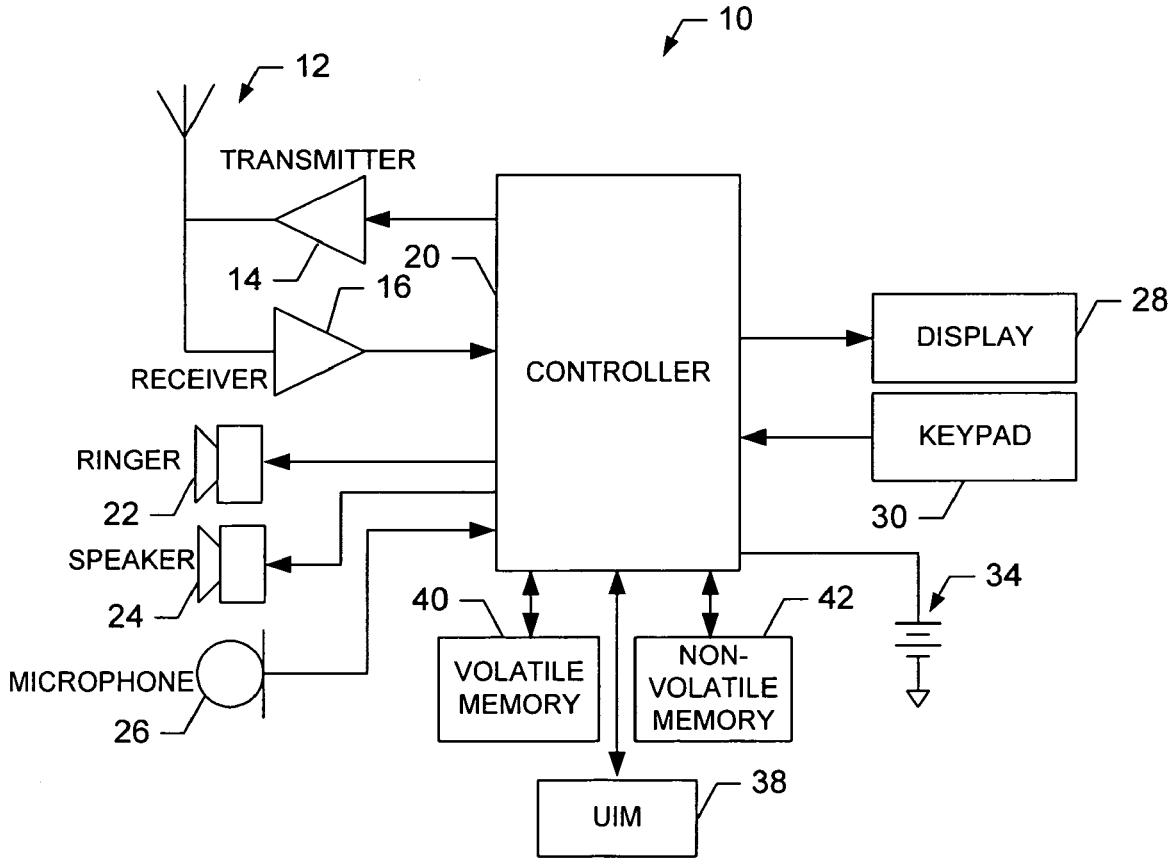
FIG. 1 is a schematic block diagram of a mobile terminal according to an exemplary embodiment of the present invention.

FIG. 1 illustrates a block diagram of a mobile terminal 10 that would benefit from embodiments of the present invention. It should be understood, however, that a mobile telephone as illustrated and hereinafter described is merely illustrative of one type of apparatus that would benefit from embodiments of the present invention and, therefore, should not be taken to limit the scope of embodiments of the present invention. While several embodiments of the mobile terminal 10 are illustrated and will be hereinafter described for purposes of example, other types of mobile terminals, such as portable digital assistants (PDAs), pagers, mobile televisions, gaming devices, music players, laptop computers and other types of audio, voice and text communications systems, can readily employ embodiments of the present invention. In addition to mobile devices, home appliances such as personal computers, game consoles, set-top-boxes, personal video recorders, TV receivers, loudspeakers, and others, can readily employ embodiments of the present invention. In addition to home appliances, data servers, web servers, databases, or other service providing components can readily employ embodiments of the present invention.

In addition, while several embodiments of the method of the present invention are performed or used by a mobile terminal 10, the method may be employed by other than a mobile terminal. Moreover, the system and method of embodiments of the present invention will be primarily described in conjunction with mobile communications applications. It should be understood, however, that the system and method of embodiments of the present invention can be utilized in conjunction with a variety of other applications, both in the mobile communications industries and outside of the mobile communications industries.

The mobile terminal 10 includes an antenna 12 in operable communication with a transmitter 14 and a receiver 16. The mobile terminal 10 further includes a controller 20 or other processing element that provides signals to and receives signals from the transmitter 14 and receiver 16, respectively. The signals include signaling information in accordance with the air interface standard of the applicable cellular system, and also user speech and/or user generated data. In this regard, the mobile terminal 10 is capable of operating with one or more air interface standards, communication protocols, modulation types, and access types. By way of illustration, the mobile terminal 10 is capable of operating in accordance with any of a number of first, second and/or third-generation communication protocols or the like. For example, the mobile terminal 10 may be capable of operating in accordance with second-generation (2G) wireless communication protocols IS-136 (TDMA), GSM, and IS-95 (CDMA), or with third-generation (3G) wireless communication protocols, such as UMTS, CDMA2000, and TD-SCDMA.

It is understood that the controller 20 includes circuitry required for implementing audio and logic functions of the mobile terminal 10. For example, the controller 20 may be comprised of a digital signal processor device, a microprocessor device, and various analog to digital converters, digital to analog converters, and other support circuits. Control and signal processing functions of the mobile terminal 10 are allocated between these devices according to their respective capabilities. The controller 20 thus may also include the functionality to convolutionally encode and interleave message and data prior to modulation and transmission. The controller 20 can additionally include an internal voice coder, and may include an internal data modem. Further, the controller 20 may include functionality to operate one or more software programs, which may be stored in memory. For example, the controller 20 may be capable of operating a connectivity program, such as a conventional Web browser. The connectivity program may then allow the mobile terminal 10 to transmit and receive Web content, such as location-based content, according to a Wireless Application Protocol (WAP), for example. Also, for example, the controller 20 may be capable of operating a software application capable of analyzing text and selecting music appropriate to the text. The music may be stored on the mobile terminal 10 or accessed as Web content.

The mobile terminal 10 also comprises a user interface including an output device such as a conventional earphone or speaker 24, a ringer 22, a microphone 26, a display 28, and a user input interface, all of which are coupled to the controller 20. The user input interface, which allows the mobile terminal 10 to receive data, may include any of a number of devices allowing the mobile terminal 10 to receive data, such as a keypad 30, a touch display (not shown) or other input device. In embodiments including the keypad 30, the keypad 30 may include the conventional numeric (0-9) and related keys (#, *), and other keys used for operating the mobile terminal 10. Alternatively, the keypad 30 may include a conventional QWERTY keypad arrangement. The mobile terminal 10 further includes a battery 34, such as a vibrating battery pack, for powering various circuits that are required to operate the mobile terminal 10, as well as optionally providing mechanical vibration as a detectable output.

The mobile terminal 10 may further include a universal identity element (UIM) 38. The UIM 38 is typically a memory device having a processor built in. The UIM 38 may include, for example, a subscriber identity element (SIM), a universal integrated circuit card (UICC), a universal subscriber identity element (USIM), a removable user identity element (R-UIM), etc. The UIM 38 typically stores information elements related to a mobile subscriber. In addition to the UIM 38, the mobile terminal 10 may be equipped with memory. For example, the mobile terminal 10 may include volatile memory 40, such as volatile Random Access Memory (RAM) including a cache area for the temporary storage of data. The mobile terminal 10 may also include other non-volatile memory 42, which can be embedded and/or may be removable. The non-volatile memory 42 can additionally or alternatively comprise an EEPROM, flash memory or the like, such as that available from the SanDisk Corporation of Sunnyvale, Calif., or Lexar Media Inc. of Fremont, Calif. The memories can store any of a number of pieces of information, and data, used by the mobile terminal 10 to implement the functions of the mobile terminal 10. For example, the memories can include an identifier, such as an international mobile equipment identification (IMEI) code, capable of uniquely identifying the mobile terminal 10.

Figure 2:
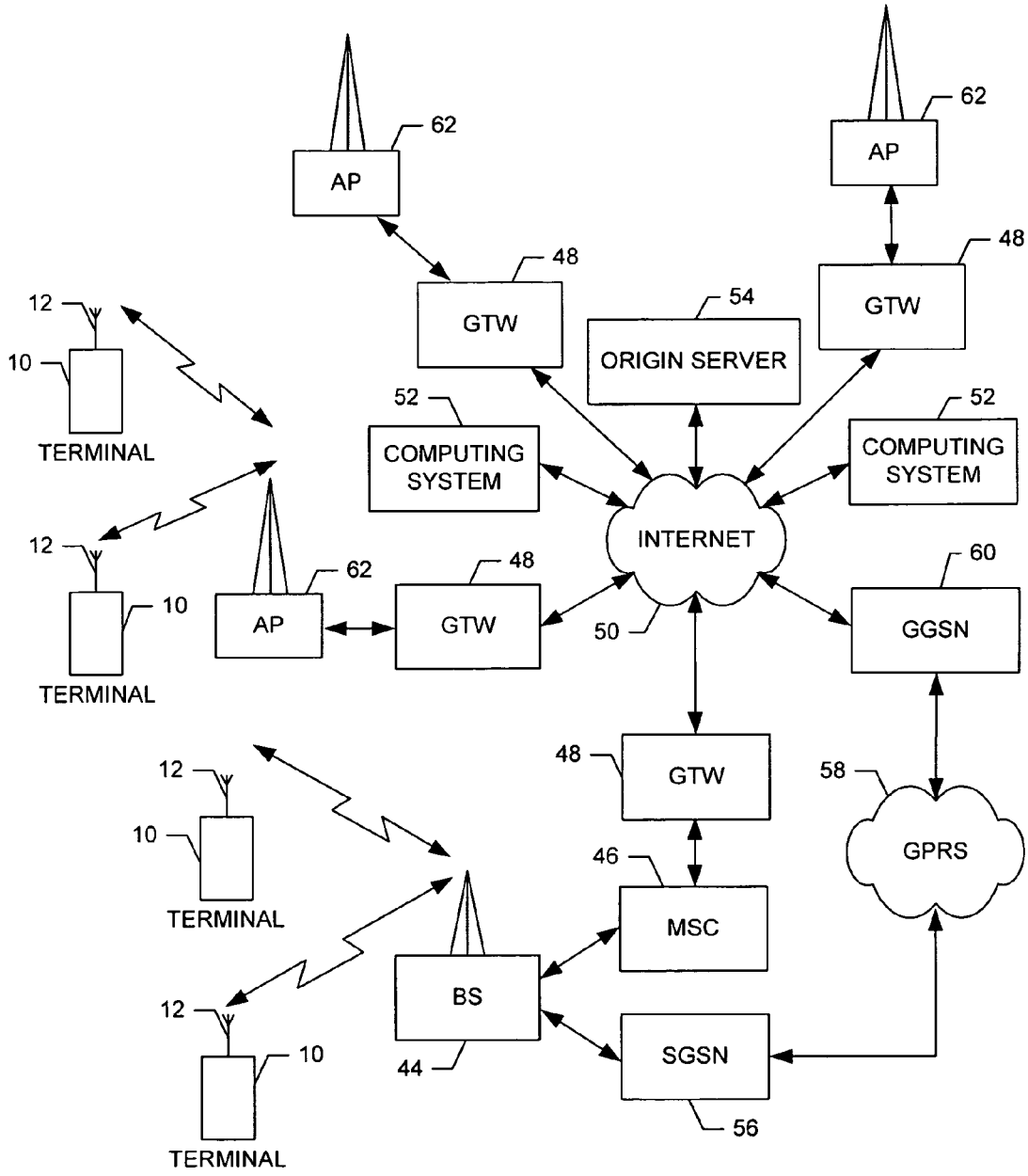
FIG. 2 is a schematic block diagram of a wireless communications system according to an exemplary embodiment of the present invention.

Referring now to FIG. 2, an illustration of one type of system that would benefit from embodiments of the present invention is provided. The system includes a plurality of network devices. As shown, one or more mobile terminals 10 may each include an antenna 12 for transmitting signals to and for receiving signals from a base site or base station (BS) 44. The base station 44 may be a part of one or more cellular or mobile networks each of which includes elements required to operate the network, such as a mobile switching center (MSC) 46. As well known to those skilled in the art, the mobile network may also be referred to as a Base Station/MSC/Interworking function (BMI). In operation, the MSC 46 is capable of routing calls to and from the mobile terminal 10 when the mobile terminal 10 is making and receiving calls. The MSC 46 can also provide a connection to landline trunks when the mobile terminal 10 is involved in a call. In addition, the MSC 46 can be capable of controlling the forwarding of messages to and from the mobile terminal 10, and can also control the forwarding of messages for the mobile terminal 10 to and from a messaging center. It should be noted that although the MSC 46 is shown in the system of FIG. 2, the MSC 46 is merely an exemplary network device and embodiments of the present invention are not limited to use in a network employing an MSC.

The MSC 46 can be coupled to a data network, such as a local area network (LAN), a metropolitan area network (MAN), and/or a wide area network (WAN). The MSC 46 can be directly coupled to the data network. In one typical embodiment, however, the MSC 46 is coupled to a GTW 48, and the GTW 48 is coupled to a WAN, such as the Internet 50. In turn, devices such as processing elements (e.g., personal computers, server computers or the like) can be coupled to the mobile terminal 10 via the Internet 50. For example, as explained below, the processing elements can include one or more processing elements associated with a computing system 52 (two shown in FIG. 2), origin server 54 (one shown in FIG. 2) or the like, as described below.

The BS 44 can also be coupled to a signaling GPRS (General Packet Radio Service) support node (SGSN) 56. As known to those skilled in the art, the SGSN 56 is typically capable of performing functions similar to the MSC 46 for packet switched services. The SGSN 56, like the MSC 46, can be coupled to a data network, such as the Internet 50. The SGSN 56 can be directly coupled to the data network. In a more typical embodiment, however, the SGSN 56 is coupled to a packet-switched core network, such as a GPRS core network 58. The packet-switched core network is then coupled to another GTW 48, such as a GTW GPRS support node (GGSN) 60, and the GGSN 60 is coupled to the Internet 50. In addition to the GGSN 60, the packet-switched core network can also be coupled to a GTW 48. Also, the GGSN 60 can be coupled to a messaging center. In this regard, the GGSN 60 and the SGSN 56, like the MSC 46, may be capable of controlling the forwarding of messages, such as MMS messages. The GGSN 60 and SGSN 56 may also be capable of controlling the forwarding of messages for the mobile terminal 10 to and from the messaging center.

In addition, by coupling the SGSN 56 to the GPRS core network 58 and the GGSN 60, devices such as a computing system 52 and/or origin server 54 may be coupled to the mobile terminal 10 via the Internet 50, SGSN 56 and GGSN 60. In this regard, devices such as the computing system 52 and/or origin server 54 may communicate with the mobile terminal 10 across the SGSN 56, GPRS core network 58 and the GGSN 60. By directly or indirectly connecting mobile terminals 10 and the other devices (e.g., computing system 52, origin server 54, etc.) to the Internet 50, the mobile terminals 10 may communicate with the other devices and with one another, such as according to the Hypertext Transfer Protocol (HTTP), to thereby carry out various functions of the mobile terminals 10.

Although not every element of every possible mobile network is shown and described herein, it should be appreciated that the mobile terminal 10 may be coupled to one or more of any of a number of different networks through the BS 44. In this regard, the network(s) can be capable of supporting communication in accordance with any one or more of a number of first-generation (1G), second-generation (2G), 2.5G and/or third-generation (3G) mobile communication protocols or the like. For example, one or more of the network(s) can be capable of supporting communication in accordance with 2G wireless communication protocols IS-136 (TDMA), GSM, and IS-95 (CDMA). Also, for example, one or more of the network(s) can be capable of supporting communication in accordance with 2.5G wireless communication protocols GPRS, Enhanced Data GSM Environment (EDGE), or the like. Further, for example, one or more of the network(s) can be capable of supporting communication in accordance with 3G wireless communication protocols such as Universal Mobile Telephone System (UMTS) network employing Wideband Code Division Multiple Access (WCDMA) radio access technology. Some narrow-band AMPS (NAMPS), as well as TACS, network(s) may also benefit from embodiments of the present invention, as should dual or higher mode mobile stations (e.g., digital/analog or TDMA/CDMA/analog phones).

The mobile terminal 10 can further be coupled to one or more wireless access points (APs) 62. The APs 62 may comprise access points configured to communicate with the mobile terminal 10 in accordance with techniques such as, for example, radio frequency (RF), Bluetooth (BT), infrared (IrDA) or any of a number of different wireless networking techniques, including wireless LAN (WLAN) techniques such as IEEE 802.11 (e.g., 802.11a, 802.11b, 802.11g, 802.11n, etc.), WiMAX techniques such as IEEE 802.16, and/or ultra wideband (UWB) techniques such as IEEE 802.15 or the like. The APs 62 may be coupled to the Internet 50. Like with the MSC 46, the APs 62 can be directly coupled to the Internet 50. In one embodiment, however, the APs 62 are indirectly coupled to the Internet 50 via a GTW 48. Furthermore, in one embodiment, the BS 44 may be considered as another AP 62. As will be appreciated, by directly or indirectly connecting the mobile terminals 10 and the computing system 52, the origin server 54, and/or any of a number of other devices, to the Internet 50, the mobile terminals 10 can communicate with one another, the computing system, etc., to thereby carry out various functions of the mobile terminals 10, such as to transmit data, content or the like to, and/or receive content, data or the like from, the computing system 52. As used herein, the terms "data," "content," "information" and similar terms may be used interchangeably to refer to data capable of being transmitted, received and/or stored in accordance with embodiments of the present invention. Thus, use of any such terms should not be taken to limit the spirit and scope of the present invention.

Although not shown in FIG. 2, in addition to or in lieu of coupling the mobile terminal 10 to computing systems 52 across the Internet 50, the mobile terminal 10 and computing system 52 may be coupled to one another and communicate in accordance with, for example, RF, BT, IrDA or any of a number of different wireline or wireless communication techniques, including LAN, WLAN, WiMAX and/or UWB techniques. One or more of the computing systems 52 can additionally, or alternatively, include a removable memory capable of storing content, which can thereafter be transferred to the mobile terminal 10. Further, the mobile terminal 10 can be coupled to one or more electronic devices, such as printers, digital projectors and/or other multimedia capturing, producing and/or storing devices (e.g., other terminals). Like with the computing systems 52, the mobile terminal 10 may be configured to communicate with the portable electronic devices in accordance with techniques such as, for example, RF, BT, IrDA or any of a number of different wireline or wireless communication techniques, including USB, LAN, WLAN, WiMAX and/or UWB techniques.

An exemplary embodiment of the invention will now be described with reference to FIG. 3, in which certain elements of a system for providing beat and tatum tracking are displayed. The system of FIG. 3 may be employed, for example, on the mobile terminal 10 of FIG. 1. However, it should be noted that the system of FIG. 3, may also be employed on a variety of other devices, both mobile and fixed, and therefore, embodiments of the present invention should not be limited to application on devices such as the mobile terminal 10 of FIG. 1. Thus, although FIG. 3 and subsequent figures will be described in terms of a system for providing beat and tatum tracking which is employed on a mobile terminal, it will be understood that such description is merely provided for purposes of explanation and not of limitation. Moreover, the system for providing beat and tatum tracking could be embodied in a standalone device or a computer program product and thus, the system of FIG. 3 need not actually be employed on any particular device. It should also be noted, that while FIG. 3 illustrates one example of a configuration of a system for providing beat and tatum tracking, numerous other configurations may also be used to implement embodiments of the present invention.

Figure 3:
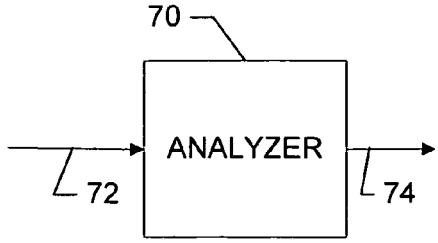
FIG. 3 illustrates a block diagram of an analyzer for providing beat and tatum tracking according to an exemplary embodiment of the present invention.

Referring now to FIG. 3, a system for providing beat and tatum tracking is provided. The system includes a musical signal analyzer 70 which receives an audio signal 72 as an input and performs a relatively highly efficient beat tracker algorithm described in greater detail herein. The audio signal 72 may be polyphonic music which can originate from a number of sources, e.g., CD records, encoded music (MP3 or others), microphone input, etc. For example, the audio signal 72 may be an audio playback of a music file that is stored in a memory of the mobile terminal 10 or otherwise accessible to the mobile terminal 10 via, for example, either a wireless or wired connection to a network device capable of storing the music file. The analyzer 70 can process music in the audio signal regardless of the source of the audio signal 72. In response to receipt of the audio signal 72, the analyzer 70 produces an output 74 indicating times of beats and tatums in the audio signal 72. In applications, devices, or services, which do not benefit from detailed beat and tatum times, only the beat period may be produced, in terms of beats per minute (BPM).

The analyzer 70 may be any device or means embodied in either hardware, software, or a combination of hardware and software capable of determining beat and tatum information as described below. The analyzer 70 may be embodied in software as instructions that are stored on a memory of the mobile terminal 10 and executed by the controller 20. In an exemplary embodiment, the analyzer 70 is embodied in C++ programming language in either an S60 platform or a Win32 platform. However, the analyzer 70 may alternatively operate under the control of a corresponding local processing element or a processing element of another device not shown in FIG. 3. A processing element such as those described above may be embodied in many ways. For example, the processing element may be embodied as a processor, a coprocessor, a controller or various other processing means or devices including integrated circuits such as, for example, an ASIC (application specific integrated circuit). The analyzer 70 may operate in real time or synchronous fashion, analyzing music signals causally, and/or in non-real-time or asynchronous fashion, analyzing entire pieces of music at once.

Figure 4:
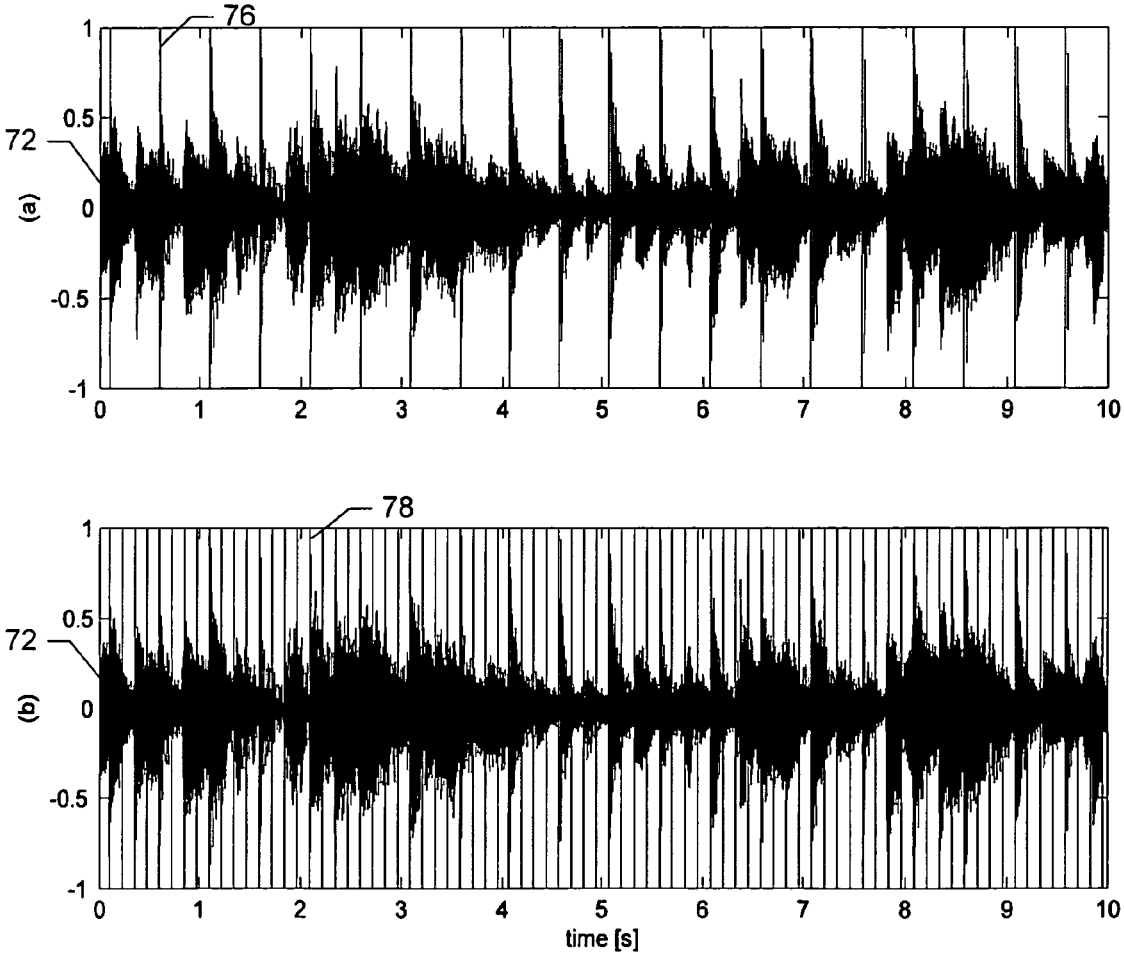
FIG. 4 illustrates an exemplary input audio signal and superimposed beats and tatums according to an exemplary embodiment of the present invention.

As stated above, the output 74 of the analyzer 70 is beat and tatum times, as demonstrated in FIG. 4. The beat and tatum times can be stored or utilized as such, or the beat and tatum times can be further processed into other information such as, for example, the tempo of music in beats per minute (BPM). As shown in FIG. 4(*a*), the analyzer 70 is capable of determining beat times 76 which are indicated by vertical lines. Meanwhile, vertical lines in FIG. 4(*b*) indicate tatum times 78. Thus, as shown in FIGS. 4(*a*) and 4(*b*), the input signal 72 has a tempo of about 120 BPM and about 4 tatums per beat.

Figure 5:
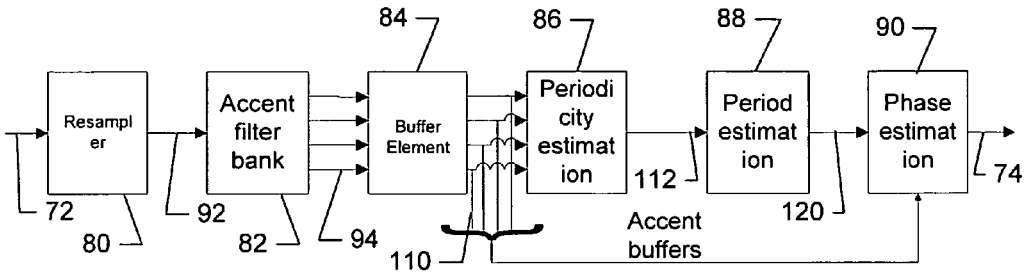
FIG. 5 is a block diagram showing elements of the analyzer for providing beat and tatum tracking according to an exemplary embodiment of the present invention.

FIG. 5 is a functional block diagram illustrating the analyzer 70 according to an exemplary embodiment in greater detail. In this regard, the analyzer 70 may include various stages or elements. For example, as shown in FIG. 5, the analyzer 70 may include a resampler 80, an accent filter bank 82, a buffer element 84, a periodicity estimator 86, a period estimator 88 and a phase estimator 90. Each of the resampler 80, the accent filter bank 82, the buffer element 84, the periodicity estimator 86, the period estimator 88 and the phase estimator 90 may be any device or means embodied in either hardware, software, or a combination of hardware and software capable of performing the corresponding function associated with each of the above elements as described below. It should be noted, however, that FIG. 5 merely provides an exemplary configuration for the analyzer 70 and embodiments of the invention may also employ other configurations.

The resampler 80 resamples the audio signal 72 at a fixed sample rate. The fixed sample rate may be predetermined, for example, based on attributes of the accent filter bank 82. Because the audio signal 72 is resampled at the resampler 80, data having arbitrary sample rates may be fed into the analyzer 70 and conversion to a sample rate suitable for use with the accent filter bank 82 can be accomplished, since the resampler 80 is capable of performing any necessary upsampling or downsampling in order to create a fixed rate signal suitable for use with the accent filter bank 82. As an alternative or in addition to the resampler 80, the analyzer 70 may include an analog-to-digital converter. Thus, if the audio signal 72 is an analog signal or if audio decoding is desired from music encoded in forms such as MP3 or AAC, the analyzer 70 can accommodate such input signals. An output of the resampler 80 may be considered as resampled audio input 92.

In an exemplary embodiment, before any audio analysis takes place, the audio signal 72 is converted to a chosen sample rate, for example, in about a 20-30 kHz range, by the resampler 80. One embodiment uses 24 kHz as an example realization. The chosen sample rate is desirable because analysis via embodiments of the invention occurs on specific frequency regions. Resampling can be done with a relatively low-quality algorithm such as linear interpolation, because high fidelity is not required for successful beat and tatum analysis. Thus, in general, any standard resampling method can be successfully applied. In an exemplary embodiment, given an input signal x[n], a resampled signal y[k] is shown by equation (1)

$$y[k]=(1-\lambda)x[m]+\lambda x[m+1]$$

$$m=\lfloor k\sigma \rfloor$$

$$\lambda=k\sigma-m, \tag{1}$$

where $$\sigma=\frac{f_s}{24000\ \text{Hz}}$$

is a ratio of incoming and outgoing sample rates. In this exemplary embodiment, the resampled signal y[k] is fixed to a 24 kHz sample rate regardless of the sample rate of the audio signal 72.

The accent filter bank 82 is in communication with the resampler 80 to receive the resampled audio input 92 from the resampler 80. The accent filter bank 82 implements signal processing in order to transform the resampled audio input 92 into a form that is suitable for beat and tatum analysis. The accent filter bank 82 preprocesses the resampled audio input 92 to generate sub-band accent signals 94. The sub-band accent signals 94 each correspond to a specific frequency region of the resampled audio input 92. As such, the sub-band accent signals 94 represent an estimate of a perceived accentuation on each sub-band. Much of the original information of the audio signal 72 is lost in the accent filter bank 82 since the sub-band accent signals 94 are heavily downsampled. It should be noted that although FIG. 5 shows four sub-band accent signals 94, any number of sub-band accent signals 94 are possible.

Figure 6:
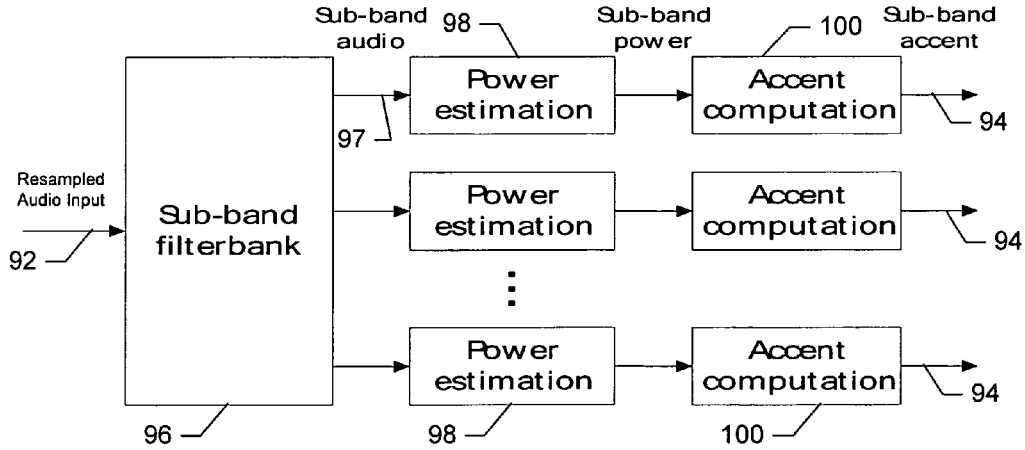
FIG. 6 is a block diagram showing portions of an accent filter bank according to an exemplary embodiment of the present invention.

An exemplary embodiment of the accent filter bank 82 is shown in greater detail in FIG. 6. In general, however, the accent filter bank 82 may be embodied as any means or device capable of downsampling input data. As referred to herein, the term downsampling is defined as lowering a sample rate, together with further processing, of sampled data in order to perform a data reduction. As such, an exemplary embodiment employs the accent filter bank 82, which acts as a decimating sub-band filterbank and accent estimator, to perform such data reduction. An example of a suitable decimating sub-band filterbank may include quadrature mirror filters as described below.

As shown in FIG. 6, the resampled audio signal 92 is first divided into sub-band audio signals 97 by a sub-band filterbank 96, and then a power estimate signal indicative of sub-band power 99 is calculated separately for each band at corresponding power estimation elements 98. Alternatively, a level estimate based on absolute signal sample values may be employed. A sub-band accent signal 94 may then be computed for each band by corresponding accent computation elements 100. Computational efficiency of a beat tracking algorithm employed by the analyzer 70 is, to a large extent, determined by front-end processing at the accent filter bank 82, because the audio signal sampling rate is relatively high such that even a modest number of operations per sample will result in a large number operations per second. Therefore, for this embodiment, the sub-band filterbank 96 is implemented such that the sub-band filterbank 96 may internally downsample (or decimate) input audio signals. Additionally, the power estimation provides a power estimate averaged over a time window, and thereby outputs a signal downsampled once again.

As stated above, the number of audio sub-bands can vary. However, an exemplary embodiment having four defined signal bands has been shown in practice to include enough detail and provides good computational performance. In the current exemplary embodiment, assuming 24 kHz input sampling rate, the frequency bands may be, for example, 0-187.5 Hz, 187.5-750 Hz, 750-3000 Hz, and 3000-12000 Hz. Such a frequency band configuration can be implemented by successive filtering and downsampling phases, in which the sampling rate is decreased by four in each stage. For example, in FIG. 7, the stage producing sub-band accent signal (a) downsamples from 24 kHz to 6 kHz, the stage producing sub-band accent signal (b) downsamples from 6 kHz to 1.5 kHz, and the stage producing sub-band accent signal (c) downsamples from 1.5 kHz to 375 Hz. Alternatively, more radical downsampling may also be performed. Because, in this embodiment, analysis results are not in any way converted back to audio, actual quality of the sub-band signals is not important. Therefore, signals can be further decimated without taking into account aliasing that may occur when downsampling to a lower sampling rate than would otherwise be allowable in accordance with the Nyquist theorem, as long as the metrical properties of the audio are retained.

Figure 7:
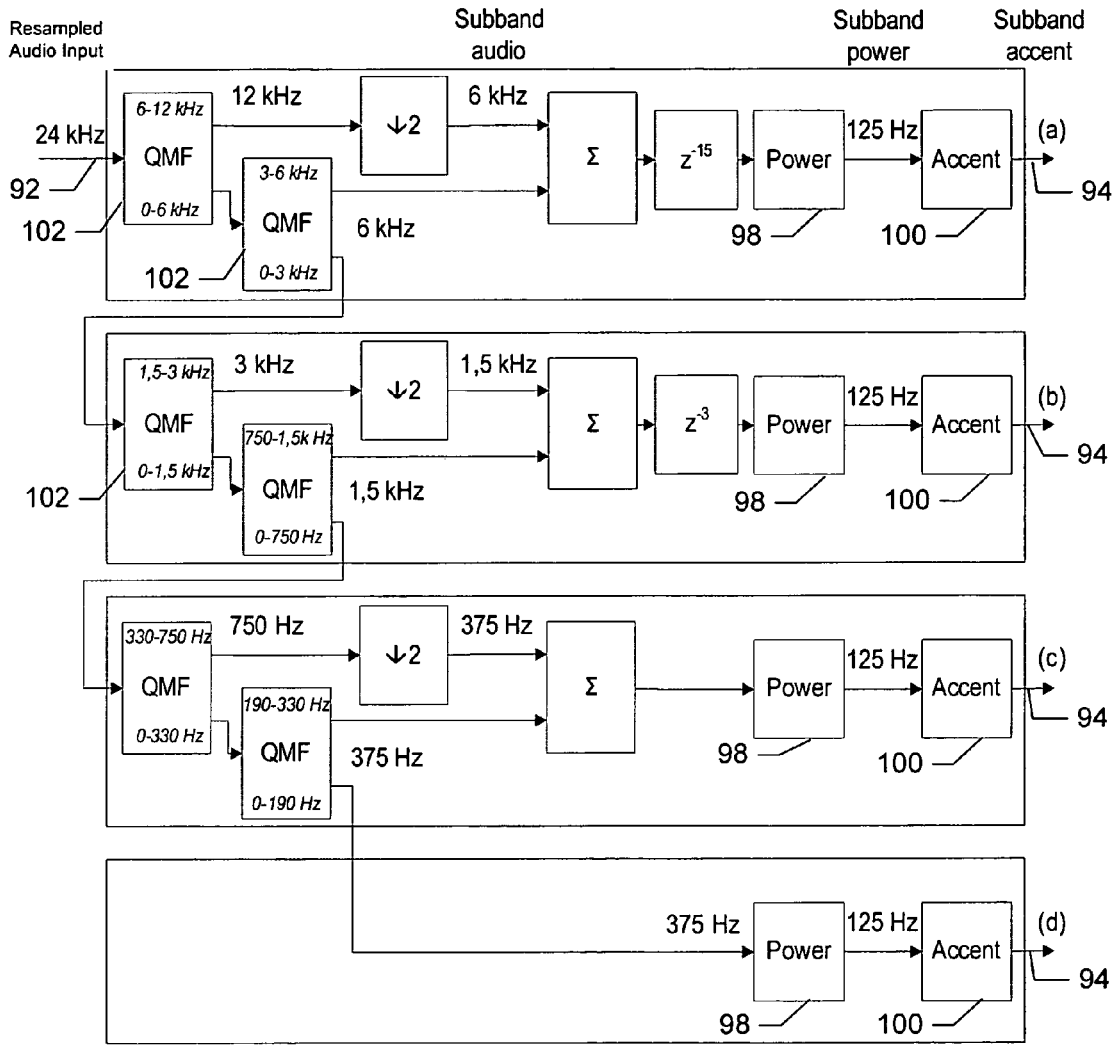
FIG. 7 is a block diagram showing portions of an accent filter bank according to an exemplary embodiment of the present invention.

FIG. 7 illustrates an exemplary embodiment of the accent filter bank 82 in greater detail. The accent filter bank 82 divides the resampled audio signal 92 to seven frequency bands (12 kHz, 6 kHz, 3 kHz, 1.5 kHz, 750 Hz, 375 Hz and 125 Hz in this example) by means of quadrature mirror filtering via quadrature mirror filters (QMF) 102. Seven one-octave sub-band signals from the QMFs 102 are combined in four two-octave sub-band signals (a) to (d). In this exemplary embodiment, the two topmost combined sub-band signals (i.e., (a) and (b)) are delayed by 15 and 3 samples, respectively, (at $z^{-15}$ and $z^{-3}$, respectively) to equalize signal group delays across sub-bands. The power estimation elements 98 and accent computation elements 100 generate the sub-band accent signal 94 for each sub-band.

Figure 8:
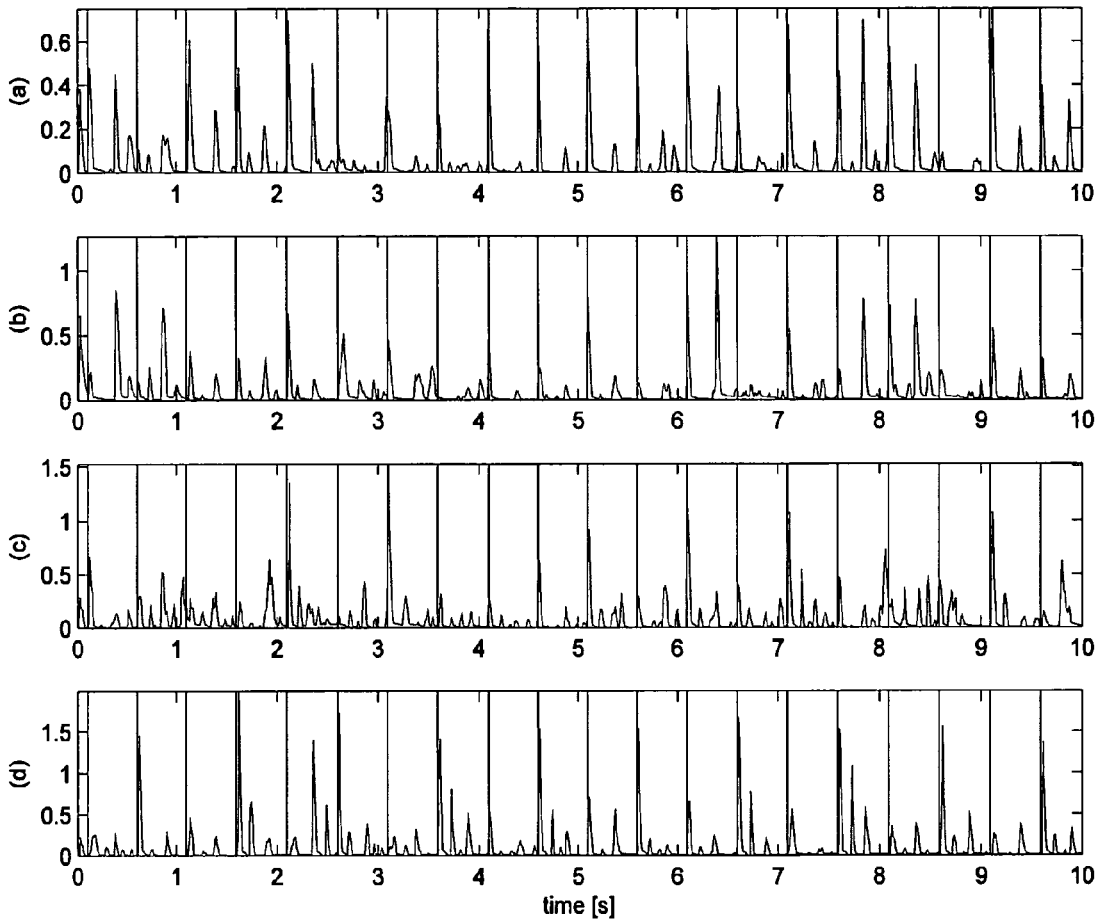
FIG. 8 shows exemplary sub-band accent signals with superimposed beats according to an exemplary embodiment of the present invention.

FIG. 8 illustrates examples of sub-band accent signals 94 from highest (a) to lowest (d) sub-band. As shown in FIG. 8, the sub-band accent signals 94 (a) to (d) are impulsive in nature. As such, the sub-band accent signals 94 reach peak values whenever high accents occur in music and remain low otherwise. In FIG. 8, as previously indicated in regard to FIG. 4(*a*), vertical lines correspond to beat times. The high computational efficiency of the beat tracker algorithm is achieved in large part due to the downsampling which occurs at the accent filter bank 82. Such efficiency results from reducing the sample rate 192-fold in the accent filter bank 82 (i.e., from 24 kHz sampled audio to 125 Hz sampled accents). In this regard, each of the QMFs 102 creates a twofold reduction, and sub-band power signals are downsampled to 125 Hz sample rate at the power estimation elements 98.

Figure 9:
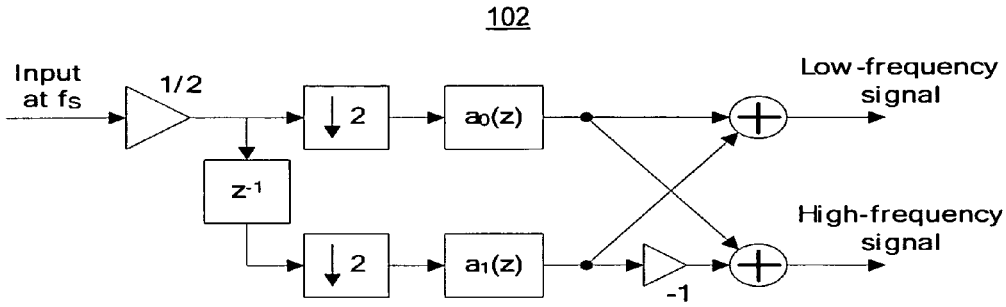
FIG. 9 is a schematic diagram illustrating a quadrature mirror filter assembly according to an exemplary embodiment of the present invention.

Accordingly, this exemplary embodiment illustrates a highly efficient structure that can be used to implement downsampling QMF analysis with just two all-pass filters and an addition and a subtraction. A structure capable of providing such downsampling as described above is illustrated in FIG. 9, which illustrates an exemplary QMF analysis implementation. The all-pass filters ($a_0(z)$ and $a_1(z)$) for this exemplary embodiment can be first-order filters, because only modest separation is required between bands. Every other sample is split between branches of the QMF such that, following a gain adjustment of one-half, every second sample passes through the branch following delay $z^{-1}$.

Figure 10:
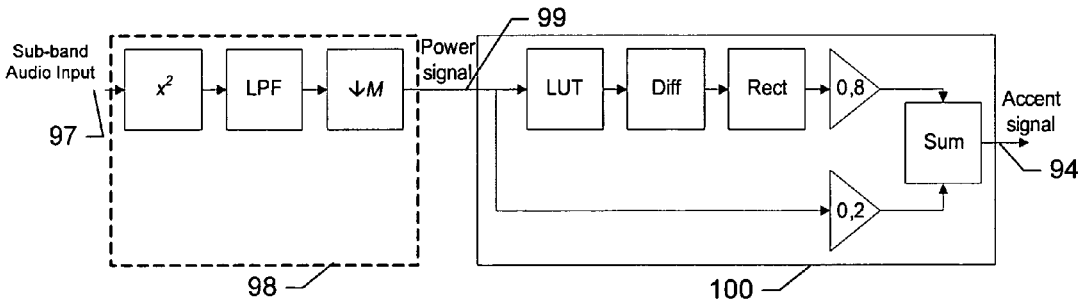
FIG. 10 is a block diagram showing a portion of an accent filter bank according to an exemplary embodiment of the present invention.

FIG. 10 shows an exemplary embodiment of the accent filter bank 82 in which one of the power estimation elements 98 and a corresponding one of the accent computation elements 100 are shown in greater detail. The sub-band audio signal 97 received from the sub-band filterbank 96 may be squared sample-by-sample (although in alternative embodiments an absolute value may be employed), low-pass filtered (LPF), and decimated by constant factor (M) to generate the sub-band power signal 99. The low-pass filter may be a first- or higher-order digital IIR (infinite impulse response) filter. If a first-order filter is implemented, the first order filter may employ the difference equation (2) below $$y[n]=b_0x[n]+b_1x[n-1]-a_0y[n-1] \quad (2)$$

where x[n] is a square of the sub-band audio input signal 97, y[n] is the filtered signal, and coefficients $a_i$ and $b_i$ are listed for this exemplary filter design in Table 1 below. The coefficients $a_i$ and $b_i$ have been computed for a low-pass filter having a 10 Hz cutoff frequency. Increasing the filter order to second or third order would have a positive impact on beat tracking performance but could simultaneously cause implementation challenges on fixed-point arithmetic.

After low-pass filtering, the signal is decimated by a sub-band specific factor M to arrive at the sub-band power signal 99. Decimation ratios are tabulated in Table 2 below. The decimation ratios have been chosen so that a power signal sample rate is equal on all sub-bands.

TABLE 1

Subband power LPF coefficients for a first-order realization.

| Subband | $b_0$ | $b_1$ | $a_0$ |
|---|---|---|---|
| (a) | 0.0052087623406230 | 0.0052087623406230 | −0.989582475318754 |
| (b) | 0.0205172390185506 | 0.0205172390185506 | −0.958965521962899 |
| (c) | 0.0774672402540719 | 0.0774672402540719 | −0.845065519491856 |
| (d) | 0.0774672402540719 | 0.0774672402540719 | −0.845065519491856 |

TABLE 2

Subband power signal decimation ratios.

| | Subband | | | |
|---|---|---|---|---|
| | (a) | (b) | (c) | (d) |
| M | 48 | 12 | 3 | 3 |

Figure 11:
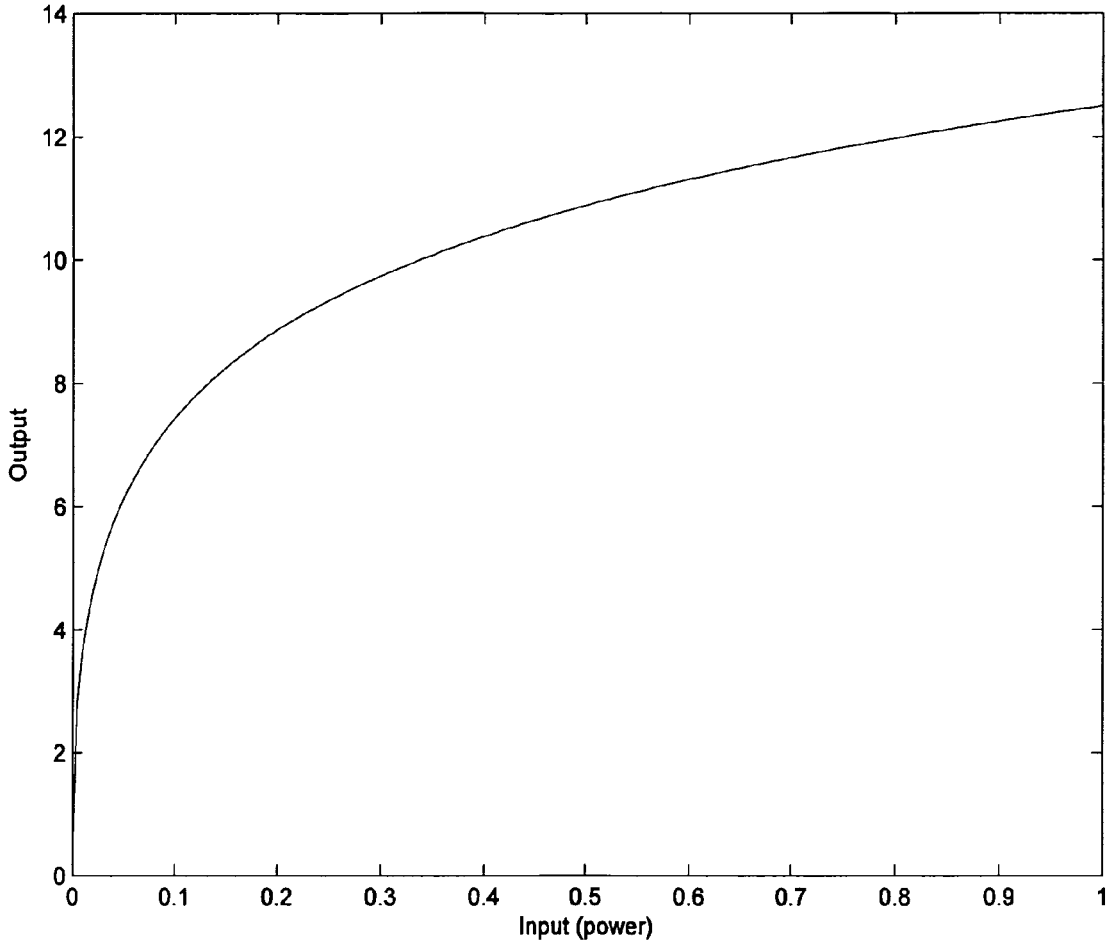
FIG. 11 shows a nonlinear power compression function for accent computation according to an exemplary embodiment of the present invention.

The sub-band power signal 99 is further processed into the sub-band accent signal 94 on each sub-band. FIG. 10 illustrates a schematic for an accent computation scheme according to one embodiment. The sub-band accent signal 94 is a weighted sum of the sub-band power signal 99 and a processed version of the sub-band power signal 99. The processed version of the sub-band power signal 99 may be produced by mapping the sub-band power signal 99 with a nonlinear level compression function, as shown in FIG. 11, which can be realized by a look-up table (LUT). The compression function realization may be defined with the formula shown in equation (3) below.

$$f(x) = \begin{cases} 5.213\ln(1+10\sqrt{x}), & x > 0.0001 \\ 5.213\ln 1.1, & \text{otherwise} \end{cases} \tag{3}$$

Note that if absolute value computation is substituted for signal squaring, then $\sqrt{x}$ becomes x. It should also be noted that other realizations of compression are possible if behavior of the realization is comparable to the example shown above. In particular, other concave functions, such as logarithm base n, $n^{th}$ roots, etc., may be substituted. After table lookup, signal values are processed with first-order difference equation (Diff) and half-wave rectified (Rect). An exemplary difference equation for x[n] input and y[n] output may be expressed as shown in equation (4) below.

$$y[n]=x[n]-x[n-1] \tag{4}$$

Meanwhile, rectification $f(x)$ of input signal values x may be defined as shown in equation (5) below.

$$f(x) = \begin{cases} x, & x > 0 \\ 0, & \text{otherwise} \end{cases} \tag{5}$$

Figure 12:
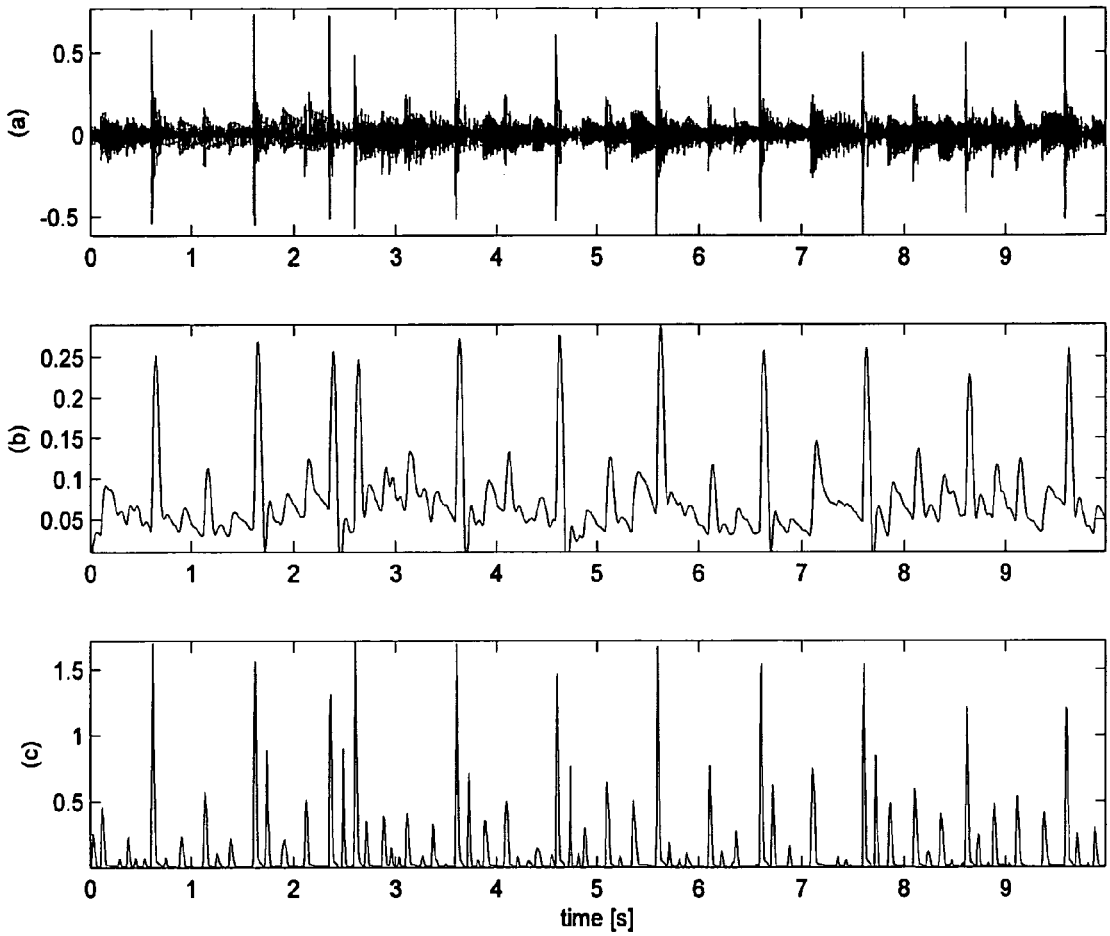
FIG. 12(*a*) illustrates an audio signal according to an exemplary embodiment of the present invention.

Rectified signal values may be multiplied by 0.8 and summed with the power signal, which has been multiplied by 0.2 as shown in FIG. 10. FIG. 12 shows an exemplary sub-band audio signal 97 in FIG. 12(*a*), the derived sub-band power signal 99 in FIG. 12(*b*), and the computed sub-band accent signal 94 in FIG. 12(*c*).

The sub-band accent signals 94 are then accumulated into buffers at the buffer element 84. The buffer element 84 may include a plurality of fixed-length buffers. Since the resampler 80 and accent filter bank 82 run synchronously with the audio signal 72, the audio signal 72 may be processed, for example, sample-by-sample or using block based processing. Accordingly, the buffer element 84 performs any chaining and/or splicing of data that is desired to create fixed-length buffers in order to support arbitrary audio buffer sizes at input to the analyzer. 70. The buffer element 84 is in communication with the periodicity estimator 86 and sends buffered accent signals 110 to the periodicity estimator 86.

Figure 13:
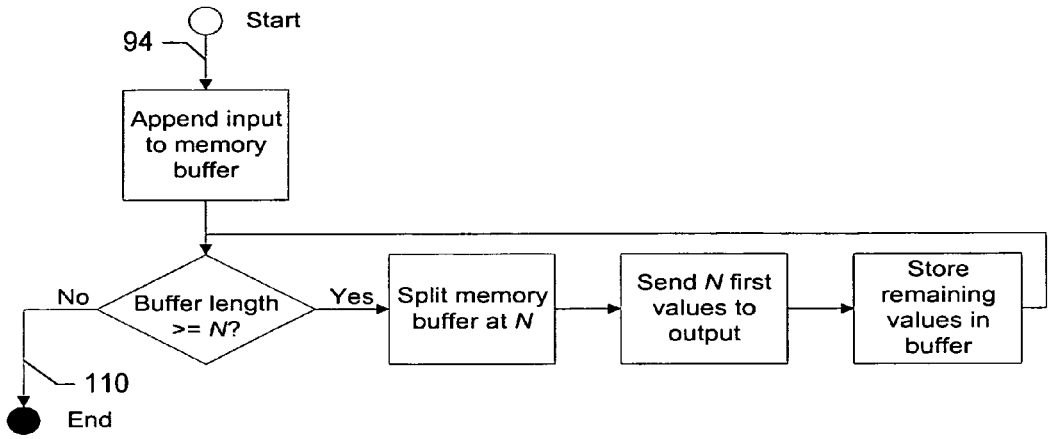
FIG. 13 illustrates an accent signal buffering flowchart according to an exemplary embodiment of the present invention.

FIG. 13 illustrates a flowchart showing operation of the buffer element 84 according to an exemplary embodiment. The buffer element 84 has an internal memory buffer which is modified in real time. Incoming signals are appended to an end of the memory buffer and outgoing signals are extracted from the memory buffer, based on lengths of incoming signal buffers and the memory buffer. The incoming signal buffers are appended to the memory buffer until the length of the memory buffer reaches a fixed minimum length N. In an exemplary implementation N=512 samples. Smaller and larger N values can be used, resulting in different system tradeoffs. For example, larger N values may improve system performance at a cost of increasing system latency.

After a sufficient number of samples (i.e., N or more samples) are in the memory buffer, the first N values are extracted while leaving remaining values in the memory buffer. The first N buffer values contain the oldest stored signal samples. Extracted samples are sent onward to periodicity estimation and the remaining values are kept in the memory buffer. The memory buffer is split repeatedly until the length of the memory buffer falls below N, at which time new input can be accepted again.

The buffered accent signals 10 are analyzed for intrinsic periodicities and combined at the periodicity estimator 86. Periodicity estimation searches for repeating accents on each sub-band (i.e., peaks in the buffered accent signals 110). The buffered accent signals 110 are matched with delayed instances of the buffered accent signals 110 and processed such that strong matches yield high periodicity values. As a result, the absolute timing information of accent peaks of the processed buffered accent signals is lost. The periodicities are first estimated on all sub-bands and then combined into a summary periodicity buffer 112 using a time window, for example, of about three to five seconds.

Figure 14:
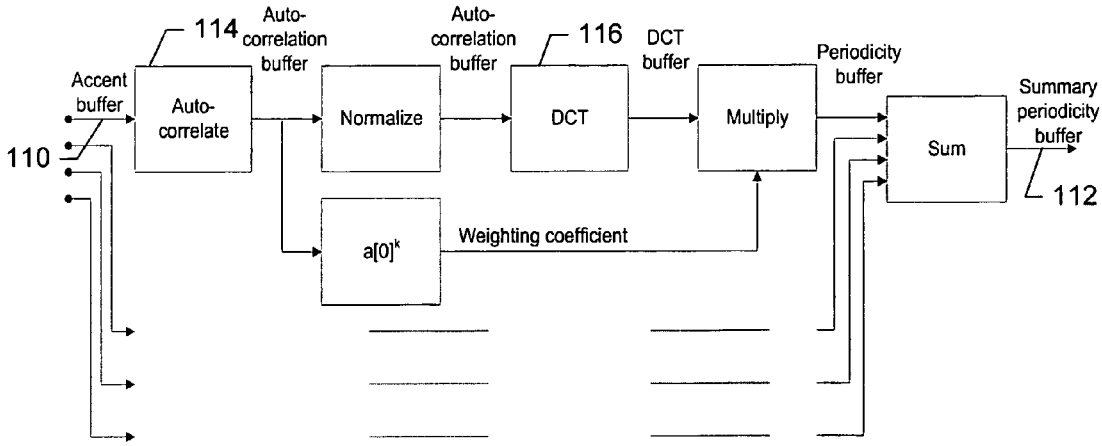
FIG. 14 is a block diagram showing periodicity estimation using a discrete cosine transform according to an exemplary embodiment of the present invention.

Operation of the periodicity estimator 86 according to an exemplary embodiment is shown in FIG. 14. As shown in FIG. 14, periodicity vectors corresponding to the buffered accent signals 110 are combined. Each buffered accent signal 110 is first processed identically and then the summary periodicity buffer 112 is obtained as a weighted sum of each of the processed buffered accent signals 110. Autocorrelation is first computed from each incoming buffered accent signal 110 at autocorrelation element 114. Autocorrelation a[l], $0 \leqq l \leqq N-1$, for each N-length accent buffer x[n] may be defined as shown below in equation (6).

$$a[\ell] = \sum_{n=0}^{N-1} x[n]x[n-\ell] \tag{6}$$

The first autocorrelation value a[0], containing a power of the accent buffer x[n], is stored and later used for the weighted addition of periodicity buffers. Then, the autocorrelation buffer is normalized according to equation (7) below.

$$\bar{a}[\ell] = \frac{a[\ell] - a_{min}}{\left(\sum_{n=0}^{N-1} a[n]\right) - Na_{min}}, \quad a_{min} = \min_n a[n] \tag{7}$$

Figure 15:
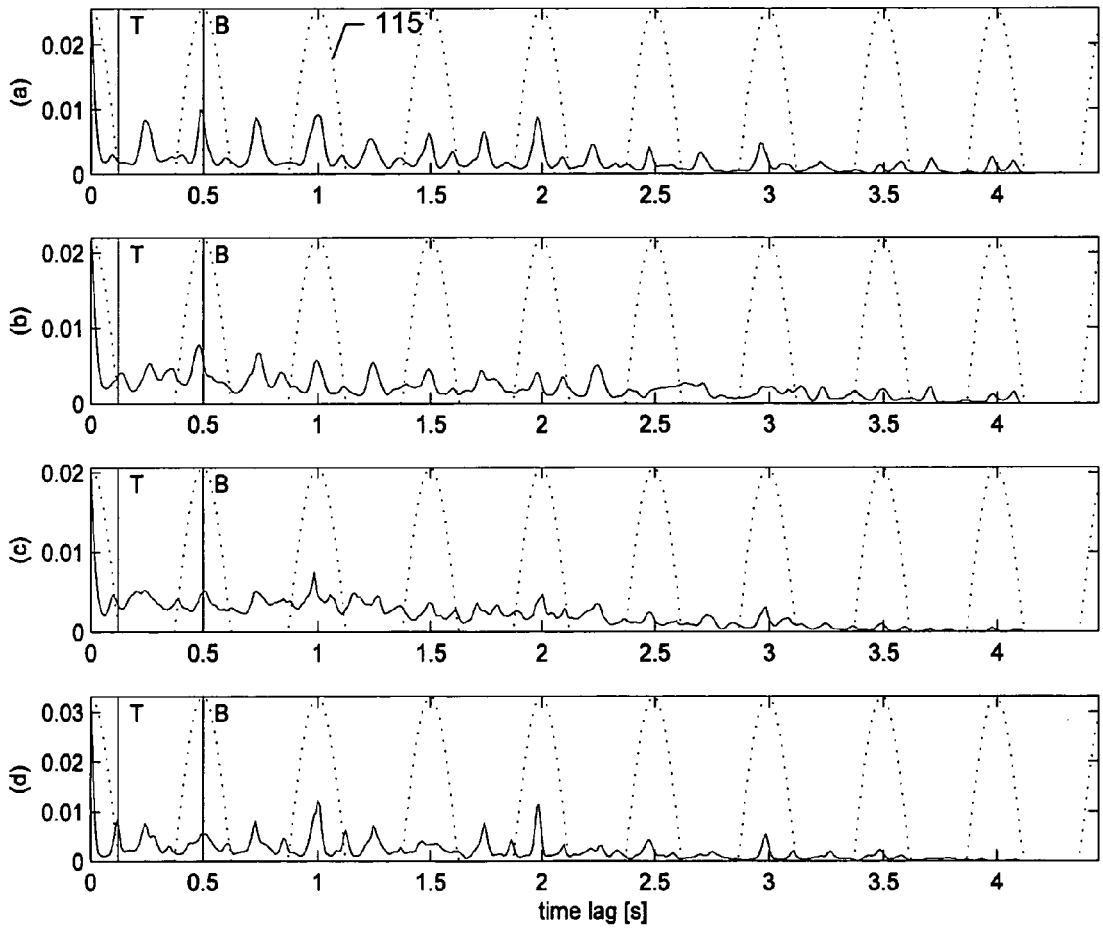
FIG. 15 illustrates example sub-band normalized autocorrelation buffers with superimposed beat and period and beat-period cosine basis functions according to an exemplary embodiment of the present invention.

The normalization eliminates all offset and range variations between autocorrelation buffers. Example normalized autocorrelation buffers are shown in FIGS. 15(*a*) to 15(*d*), for highest sub-bands in FIG. 15(*a*) to lowest sub-bands in FIG. 15(*d*), which may be computed from the sub-band accent signals 110 of FIG. 8. FIGS. 15(*a*) to 15(*d*) show a beat period (B) of 0.5 seconds, and a tatum period (T) of 0.13 seconds, as vertical lines, and dashed zero-phase beat-period cosine basis functions 115 superimposed at the beat period.

Accent signal periodicity is estimated by means of the discrete cosine transform (DCT) 116. A discrete time-domain signal x[n] has an equivalent representation X[k] in the DCT transform domain. Specialized transform algorithms such as FFT (fast Fourier transform) can be used to evaluate the value of the transformed signal X[k].

Periodicity estimation from a normalized autocorrelation buffer is a fundamental enabler of a beat and tatum analysis system. However, in order to perform periodicity estimation, repeating accents from a discrete signal may be detected. Accent peaks with a period p cause high responses in the autocorrelation function at lags l=0, l=p (pairs of nearest peaks), l=2p (second-nearest peaks), l=3p (third-nearest peaks) and so on. Such a response may be ideally represented as the zero-phase beat-period cosine basis functions 114, which are illustrated in dashed lines in FIG. 15. The zero-phase beat-period cosine basis functions 114 may be directly exploited in DCT-based periodicity estimation.

An M-point discrete cosine transform A[k] of an N-point normalized autocorrelation signal $\bar{a}[n]$ is:

$$A[k] = c_k \sum_{n=0}^{N-1} \bar{a}[n] \cos \frac{\pi(2n+1)k}{2M}, \quad (8)$$

$$c_0 = \sqrt{1/M},$$

$$c_k \sqrt{2/M}, \quad 1 \le k \le M-1.$$

The DCT 116 yields values A[k]=1 for an ideal zero-phase cosine (unity amplitude). Therefore, the DCT vector is directly applicable to periodicity estimation. The DCT vector A[k] contains frequencies ranging from zero to Nyquist, however, only a specific periodicity window, between the lower period $p_{min}$ and upper period $p_{max}$, is of interest. The periodicity window specifies the range of beat and tatum periods for estimation. Also a certain frequency resolution within the periodicity window is reached by zero-padding the autocorrelation signal prior to DCT transform. This is embedded in the DCT equation (8) above, when M>N.

As an alternative to DCT, periodicity estimation may be done by using chirp z-transform (CZT). The DCT and CZT are two transforms beneficial in periodicity analysis, in general, and rhythm analysis, in particular. By use of an M-point chirp z-transform, the periodicity function is computed as $$A[k] = 1 - \frac{\left| 1 - \sum_{n=0}^{N-1} \bar{a}[n] \beta w^{-k} \right|}{2}, \text{ where } \beta = r \exp \frac{j2\pi}{p_{max}} \text{ and}$$

$$w = \exp \frac{-j2\pi\left(\frac{1}{p_{min}} - \frac{1}{p_{max}}\right)}{M-1},$$

in place of the DCT operation. The parameter r=1 in an exemplary embodiment.

In summary, periodicity estimation includes first computing the N-point normalized autocorrelation. The autocorrelation buffer is transformed to an M-point periodicity buffer by use of the DCT, the CZT, or a similar transform, and finally weighted with $a[0]^k$ (accent buffer power raised to $k^{th}$ power), and summed. The parameter k controls the amount of weighting which is, in an exemplary embodiment, k=1.2. FIG. 16 shows exemplary periodicity vectors for each sub-band, the highest being at FIG. 16(*a*) to the lowest being at FIG. 16(*d*). FIG. 16 also shows a weighted summary periodicity at FIG. 16(*e*).

Beat and tatum periods 120 are estimated by finding the most likely beat and tatum period candidate for the summary periodicity buffer 112 at the period estimator 88. In order to estimate the beat and tatum periods 120, the summary periodicity buffer 112 is weighted with probabilistic functions modeling primitive musicological knowledge, such as relations between the beat and tatum periods, prior likelihoods, and an assumption that the tempo is slowly varying. The summary periodicity buffer 112 may be, for example, a 1 by 128 periodicity vector having values representing a strength of periodicity in the audio signal 72 for each of the period candidates. Bins of the periodicity vector correspond to a range of periods from 0.08 seconds to 2 seconds. Depending on the application different ranges of periods could also be used.

Using prior knowledge of likely different tatum and beat periods represented with prior functions obtaining values between 0 and 1 for each of the possible periods, a simple beat/tatum estimator could then be implemented by multiplying the summary periodicity with a prior function for tatum, to get a weighted summary periodicity function. The tatum period could then be determined as the period corresponding to the maximum of the weighted summary periodicity function. A similar procedure may be employed to determine the beat including weighting with a beat prior function. However, the preceding method may not give satisfactory performance since there is no tying or dependency between successive beat and tatum estimates, and the preceding method fails to take into account the structure of musical rhythms where the beat period is most likely an integer multiple of the tatum period. In addition, to be able to analyze the beat and tatum times, it may be useful to estimate the phase of the beat and tatum. Thus, a probabilistic model as described herein uses more advanced probabilistic modeling to find the best beat and tatum estimates.

The algorithm uses a probabilistic model to incorporate primitive musicological knowledge using similar weighting terms as proposed in Klapuri, et al.: Analysis of Acoustic Musical Signals, IEEE Transactions on Audio, Speech and Language Processing, Vol. 14, No. 1, January 2006, pp 342-355 at pages 344 and 345. However, the actual calculations of the probabilistic model and the way the weighting terms are applied to the observations coming from the signal processing front end are different from those proposed by Klapuri et. al. Calculation steps of an exemplary embodiment of the period estimator 88 are depicted in FIG. 17.

The periodicity estimator 88 calculates the beat and tatum weights based on the prior distributions and a "continuity function" calculated according to equation (9) below, which is provided by Klapuri et al. (2006, p 348).

$$f\left(\frac{\tau_n^i}{\tau_{n-1}^i}\right) = \frac{1}{\sigma_1\sqrt{2\pi}}\exp\left[-\frac{1}{2\sigma_1^2}\left(\ln\left(\frac{\tau_n^i}{\tau_{n-1}^i}\right)\right)^2\right] \tag{9}$$

In equation (9), $\tau_n^i$ represents a period at (current) time n, $\tau_{n-1}^i$ represents the previous period estimate and $\sigma_1$ represents a shape parameter. For example, the value $\sigma_1$=0.6325 can be used. The index i ∈{A,B}, A denotes the tatum and B the beat. The prior distributions are lognormal distributions describing the prior probability for each beat and tatum period candidate, as described in equation 10 below which is provided by Klapuri et al. (2006, p 348).

$$p(\tau^i) = \frac{1}{\tau^i\sigma^i\sqrt{2\pi}}\exp\left[-\frac{1}{2(\sigma^i)^2}\left(\ln\left(\frac{\tau^i}{m^i}\right)\right)^2\right] \tag{10}$$

In equation (10), $m^i$ and $\sigma_i$ represent scale and shape parameters, respectively. The parameters of the distributions are described by Klapuri et al. These parameters can be adjusted from those provided by Klapuri et al. to provide the best performance on the current data and the front end processing used. For example, we found out that using $\sigma_B$=0.3130 for the beat prior and $\sigma_A$=0.8721 for the tatum prior was a good choice. The prior functions were evaluated according to the equations given by Klapuri et al. and stored into lookup tables.

The continuity function $$\left(\text{i.e., } f\left(\frac{\tau_n^i}{\tau_{n-1}^i}\right)\right)$$

describes the tendency that the periods are slowly varying, thus "tying" the successive period estimates together, as suggested by Klapuri et al. Thus, the largest likelihood is around the previous period estimate, and decreases with increasing change in period. The continuity function is a normal distribution as a function of the logarithm of the ratio of successive period estimates. The continuity function causes large changes in period to be more likely for large periods, and makes period doubling and halving equally probable.

An output of operation 130 in which beat and tatum weights are updated via the continuity function described above may include two 1 by 128 weighting functions, in which one of the weighting functions is for beat and the other is for tatum. Tatum weight is calculated by multiplying the tatum prior with the tatum continuity function, and taking the square root. The continuity function is evaluated for the ratio of all period candidates (a range from 0.08 seconds to 2 seconds) and the previous tatum period. The same is done for the beat period, but now the beat prior function is multiplied with the beat continuity function, and the continuity function input parameter is the ratio of possible beat periods to the previous beat period. A median value of the history of three previous period estimates may be used as the previous period value. Such use of the median value of the history of three previous period estimates may fix errors if there are single frames in which a period estimate is incorrectly determined. At the beginning of operation, when there is no history the continuity function is unity for all period values.

Calculation of the continuity function can be implemented by storing the right hand side of the symmetric normal distribution into a look up table (LUT). The parameter of the normal distribution is the logarithm of the ratio of the possible period values to the previous period value, which is preferably within an allowed period range. In an exemplary embodiment, the range of possible periods is from 0.08 seconds to 2 seconds, limiting the range of possible input values from log(0.08)-log(2)~=-3.22 to log(2)-log(0.08)~=3.22; thus utilizing the fact that log(x/y)=log(x)-log(y). Since the normal distribution is symmetric only the positive half of the normal distribution may be stored. In an exemplary embodiment, storing only 17 values for a range of input values from [0, 3] was found sufficient. Logarithms of the possible period values are also stored into a LUT, making calculation of the logarithm difference relatively fast.

At operation 132, a final weight function is calculated by adding in a modeling of most likely relations between simultaneous beat and tatum periods. For example, music theory may suggest that the beat and tatum are more likely to occur at ratios of 2, 4, 6, and 8 than in ratios of 1, 3, 5, and 7. A period relation function may be calculated by forming a 128 by 128 matrix of all possible beat and tatum period combinations, and modeling the likelihood of the period combinations with a Gaussian mixture density as suggested by Klapuri et al. (2006, p 348):

$$g(x) = \sum_{l=1}^{9} w_l N(x; l, \sigma_2) \tag{11}$$

In equation (11), g(x) represents a Gaussian mixture density, $$x = \frac{\tau^B}{\tau^A},$$

i.e. the ratio of the beat and the tatum period, l are the component means and $\sigma_2$=0.3 is the variance that may be common for all Gaussians. Some parameter adjustments were done also here, the weight values $w_i$,i=1, . . . ,9 were found out by experimentation and the values $w_i$={0.0741, 0.1852, 0.1389, 0.1852, 0.0463, 0.1111, 0.0741, 0.1111, 0.0741} may, for example, be used. In an exemplary embodiment, the likelihood values were evaluated for the possible beat and tatum period combinations using the equation (11) above, the likelihood values were raised to the power of 0.2 after multiplication, and stored into a LUT. FIG. 18 shows a resulting 128 by 128 likelihood surface that may be stored into a LUT according to the exemplary embodiment.

Columns of the period relation likelihood surface correspond to different beat period candidates, and the rows correspond to different tatum period candidates. The final step in forming the probability weighting functions is to multiply the rows with the beat weighting function calculated in the previous step, and the columns with the tatum weighting function. After both multiplications the square root may be taken of the result to spread the resulting weighting function. The output of this step is the final 128 by 128 weighting function for all beat and tatum period combinations, having values from the range [0, 1]. Thus, for each possible combination ($\hat{\tau}_n^B$, $\hat{\tau}_n^A$) of beat period $\hat{\tau}_n^B$ and tatum period candidates $\hat{\tau}_n^A$ we get a single weight value that combines all our likelihood terms: the likelihood of the periods $\hat{\tau}_n^B$ and $\hat{\tau}_n^A$ to occur jointly, the prior likelihood for the both periods, and the likelihood to observe these periods at time n when we know the previous estimates at previous times (e.g. at n−1).

At operation 134, weighted periodicity is calculated by weighting the summary periodicity buffer 112 with the obtained likelihood weighting function. For example, it may be assumed that the likelihood of observing a certain beat and tatum combination is proportional to a sum of the corresponding values of the summary periodicity. Thus, the sum of the summary periodicity values corresponding to each beat and tatum period combination may be calculated. The sum may be divided by two to get an average of the summary periodicity values. An observation matrix of the same size as our weighting function is produced by calculating the average of values corresponding to the different beat and tatum period combinations. The observation matrix may then be multiplied with the weighting matrix, giving a weighted 128 by 128 periodicity matrix. Instead of using a sum or average of the summary periodicity values corresponding to different beat and tatum period candidates, a product of the corresponding values of the summary periodicity could, for example, be used instead.

Finally, at operation 136, a maximum is found from the weighted periodicity matrix. The index of the maximum value indicates the most likely beat and tatum period combination. The column index of the maximum value corresponds to the most likely beat period candidate, and the row index to the most likely tatum period candidate. To improve the precision of period estimates, an interpolated peak picking step may be performed. From an initial period candidate c, a more accurate value $\hat{c}$ is found by maximization $$\hat{c} = \frac{1}{\arg\max_{c} \sum_{k} s\left(\frac{k}{c}\right)}$$

in the neighborhood of the initial candidate c, where s(x) is the summary periodicity function interpolated from the summary periodicity buffer 112. The resulting period candidates are passed on to the phase estimator 90.

The beat and tatum times of the output signal 74 are positioned, based on knowledge of the beat and tatum periods 120 and accent information at the phase estimator 90. A weighted accent signal is formed as a linear combination of the bandwise accent signals. The weight values can be 5, 4, 3, and 2 from the lowest frequency band to the highest frequency accent signal band, respectively. This weighted accent signal is fed into the phase estimator. The phase estimator 90 finds a beat phase (i.e. location of the first beat in a current frame with respect to a beginning of the frame). Additionally, the weighted accent signal is filtered with a comb filter tuned to the current beat period, and a score is calculated for a set of phase estimates by averaging an output of the comb filter at intervals of the beat period. The phase estimator 90 may also refine the beat period to correspond to the previous beat period, if a comb filter tuned to the previous beat period gives a larger score. Based on the beat and tatum period 120 and the common phase, the beat and tatum times of the output signal 74 are calculated for each audio frame.

FIG. 19 illustrates a process of phase estimation at the phase estimator 88 according to an exemplary embodiment. Only the beat phase is estimated, the tatum phase is set according to the beat phase. Observation for the period estimator 88 may be a frame of length N of the weighted accent signal v(n), where n=k, . . . ,k+N−1. In an exemplary implementation N=512 samples. A weighted sum of the accent signal 110 may be used for phase estimation. The weights may also be set to zero for some bands, and thus for example only the buffered accent signal 110 of the lowest frequency band from the accent filter bank 82 may be used for phase estimation.

A bank of comb filters with constant half time and delays corresponding to different period candidates may be employed to measure the periodicity in accentuation signals. Another benefit of comb filters is that an estimate of the phase of the beat pulse is readily obtained by examining comb filter states, as suggested by Scheirer in Eric D. Scheirer: "Tempo and beat analysis of acoustic musical signals, J. Acoust. Soc. Am., 103(1): 588-601, January 1998". However, implementing a bank of comb filters across the range of possible beat and tatum periods is computationally very intensive. Accordingly, the phase estimator 90 of an exemplary embodiment presents a novel way of utilizing the benefits of comb filters as both period and phase estimators, having a fraction of the computational cost of a bank of comb filters. The phase estimator 90 implements two comb filters. An output of a comb filter with delay τ for the input v(n) is given by equation (12) below.

$$r(\tau,n)=\alpha_\tau r(\tau,n-\tau)+(1-\alpha_\tau)v(n) \tag{12}$$

Parameters of the two comb filters may be dynamically adjusted to correspond to a current beat period estimate obtained from the period estimator 88 and a previous period estimate. According to an exemplary embodiment, the parameters include a delay τ which may be set equal to the current beat period estimate $\hat{\tau}_B$, and a feedback gain $\alpha_\tau=0.5^{\tau/\tau^0}$. The feedback gain values corresponding to a range of different integer beat period values and the half time $T_0$ of, for example, 3 seconds may be calculated and stored into a lookup table.

The phase estimation starts by finding a prediction $\hat{\phi}_n$ for a beat phase $\phi_n$ in a current frame, during phase prediction at operation 150. The prediction for the beat phase may be obtained by adding the current beat period estimate to an index of the last beat in the previous frame, and subtracting the frame length. In some cases when the beat period estimate becomes small compared to the previous estimate, a beat period estimate obtained in this way might become negative. Thus, if the beat period estimate becomes negative, the phase prediction is set to zero. Another source of prediction for the beat phase may be location of a maximum peak value in a comb filter delay line. However, since two comb filters instead of a bank of filters are employed, the comb filter parameters may be dynamically adjusted. Thus, this prediction source may not always be available, since the filter state may be reset if the period estimate has changed. When a comb filter state vector is not zero, and when the location of the maximum peak in the comb filter state is within about +/−17% of the distance of the prediction based the beat location in the previous frame, the prediction from the comb filter state may be used as the prediction $\hat{\phi}_n$ for the beat phase.

A weighted accent signal (i.e. a linear summation of the buffered accent signals 110) is passed through comb filter 1 at operation 152, giving an output $r_1(\tau,n)$. If there are peaks in the accent signal at intervals corresponding to the comb filter delay, the output level of the comb filter will be large due to a resonance. A score is then calculated for the different phase estimates in the current frame at operation 154. The score is the average of the values of comb filter output $r_1(\tau,n)$ at intervals of the current beat period estimate, with the start index being the phase estimate for which the score is calculated. This is described in more detail below. If there is a phase prediction available, the score is calculated starting from phase candidates $\hat{\phi}_n-3, \hat{\phi}_n-2, \ldots, \hat{\phi}_n, \ldots, \hat{\phi}_n+3$ around the phase prediction. If there is no phase prediction available, the score is calculated for all possible phases, i.e. the set of indices $l, l \in \{k, k+1, \ldots, k+\hat{\tau}_B-1\}$. Phase prediction may not be available when there are less than 3 beat period estimates available. This occurs because, in the beginning, estimates are likely to fluctuate until the system locks to the beat phase. Accordingly, a limit to the set of potential phase candidates should not be imposed during the initial stages. It is possible to use weighting for the different phase candidates at operation 154. The weighting depends on the distance of the phase candidate from the predicted phase. Thus, for a possible phase l, we first calculate its normalized distance from the predicted phase $\hat{\phi}_n$:

normdist(l)=$[l-\hat{\phi}_n]/\hat{\tau}_B$. The weighting may then be $$w(l) = \frac{1}{\sigma_3\sqrt{2\pi}}\exp\left(-\frac{normdist(l)^2}{2\sigma_3^2}\right) \tag{13}$$

for $l \in \{k, k+1, \ldots, k+\hat{\tau}_B-1\}$. The value $\tau_3=0.1$ can, for example, be used. This kind of function was used in Klapuri et al. (2006, p 350). However, the distance function calculation has been simplified here. A final score for the different phase candidates l may then be formed as $$g_1(l)=w(l)\cdot p_1(l) \tag{14}$$

where $$p_1(l) = \frac{1}{\mathrm{card}(S(l))}\sum_{j\in S(l)} r_1(\tau, j), \tag{15}$$

and S(l) is the set of indices $l, l+\hat{\tau}_B, l+2\hat{\tau}_B, \ldots$ that are smaller or equal to M−1, i.e., those that belong to this frame. card(S(l)) denotes the number of elements in the set of indices S(l). Thus, the score $p_1(l)$ is the average of the values of comb filter output $r_1(\tau,n)$ at intervals of the current beat period estimate, with the start index being the phase estimate for which the score is calculated. The beat phase is the l that maximizes $g_1(l)$ (or $p_1(l)$, if weighting for the phase candidates is not used). The score is the maximum value of $g_1(l)$.

If there are at least three beat period predictions available, and the current beat period estimate rounded to an integer number is different than the previous period estimate (also rounded to integer), mirror operations to those described above are undertaken using the previous beat period. In other words phase prediction is undertaken at operation 160, comb filtering at operation 162, and calculating the score for phase estimates using the previous beat period as the delay of comb filter 2 is performed at operation 164. These operations are depicted by the right hand side branch (as shown) in FIG. 19. Motivation for operations 160 to 164 is provided in that if the estimate for the beat period in the current frame is erroneous, the comb filter tuned to the previous beat period may indicate this by remaining locked to the previous beat period and phase, and producing a more energetic output and thus larger score than the filter tuned to the erroneous current period.

At operation 166, scores delivered by operations 154 and 164 are compared, and the largest score determines the final beat period and phase. Thus, if the comb filter branch tuned to the previous beat period gives a larger score, the beat period estimate is adjusted equal to the previous beat period. Accordingly, the phase estimator 90 may refine the beat period estimate. Thus, utilization of two comb filters may enable both phase estimation and confirming the period estimate, without use of a comb filter bank. Of course, if the beat period estimate in the current frame is equal to the previous estimate, the right hand side branch need not be performed at all. The state of the "winning" comb filter as determined at operation 166 may be stored to be used in the next frame as comb filter 2. According to an exemplary embodiment, there might also be more than two comb filters. For example, one could develop the algorithm to use comb filters tuned according to periods that are known to be the most common failures. For example, if it is found by experimentation that the method often decides the beat period to be 2 times the correct beat period, we could implement a third comb filter to have the period that is ½ times the beat period outputted by the period estimation block. If the period estimator now made and error and estimated the beat period to be twice the correct one, this comb filter would then give a more energetic output than the one tuned to the period given by the period estimation block, and it may be determined that the beat period is 1/2 times the beat period outputted by the period estimation block. If it is known that the algorithm often makes errors that are 2 times, 2/3 times, or 0.5 times the correct beat period, use a set of five comb filters whose delays are set according to the current period estimate, previous period estimate, and 0.5, 3/2, and 2 times the current period estimate may be selected. Several variants can be implemented based on the general idea of the examples described above. Thus some common errors may be addressed that are characteristic for a particular periodicity estimation method used. Thus, it is an important aspect of the invention that comb filters are used selectively to affect the periodicity estimation, and to find the phase, instead of using a bank of comb filters all of which are run for every frame of the input signal as is done conventionally.

After the beat period and phase information is obtained, beat and tatum locations for the current audio frame may be interpolated. The first tatum location or tatum phase is $\phi_n$ mod $\tau_A$, where $\phi_n$ is the found beat phase and $\tau_A$ the tatum period. We may force the output to have an integer number of tatums per beat, since it is often desirable to make the tatum times coincide with the beat times. Thus, we may use $\tau_A$=round($\tau_B/\hat{\tau}_A$), where $\tau_B$ is the final beat period and $\hat{\tau}_A$ the estimated tatum period. One could of course adjust the beat period instead of the tatum period as well. Although such a system as described above may have a slightly reduced ability to follow rapid tempo changes, the system reduces the computational load since back end processing is done only once for each audio frame. Thus, the system can follow smooth tempo changes. In embodiments where more computational resources are available, estimates for the beat and tatum phase could naturally be calculated more often, allowing the system to track the tempo evolution even more closely.

It may be advantageous to implement the beat and tatum tracker in a real-time computer implementation by using two worker threads. The threads may operate at different rates, and allow the integration of the beat and tatum tracking feature to existing audio signal processing systems. The first thread may operate at audio frame rate and carry out the resampling and accent filter bank steps, storing the produced accent signals into a shared memory. The second thread may be signaled by an arrival of accent buffers, on a slower rate than the first thread, and may carry out the chain of processing for periodicity estimation, period estimation, and phase estimation. Therefore, the buffering stage may act as a data exchange between the first and second threads. As such, the first thread may be running synchronously with other audio processing, unaffected by the slower-rate processing. For further information regarding such an implementation, see International Publication No. WO 2005/036396 published Apr. 21, 2005 to Hiipakka et al.

FIG. 20 is a flowchart of a system, method and program product according to exemplary embodiments of the invention. It will be understood that each block or step of the flowcharts, and combinations of blocks in the flowcharts, can be implemented by various means, such as hardware, firmware, and/or software including one or more computer program instructions. For example, one or more of the procedures described above may be embodied by computer program instructions. In this regard, the computer program instructions which embody the procedures described above may be stored by a memory device of the mobile terminal and executed by a built-in processor in the mobile terminal. As will be appreciated, any such computer program instructions may be loaded onto a computer or other programmable apparatus (i.e., hardware) to produce a machine, such that the instructions which execute on the computer or other programmable apparatus create means for implementing the functions specified in the flowcharts block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the flowcharts block(s) or step(s). The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the flowcharts block(s) or step(s).

Accordingly, blocks or steps of the flowcharts support combinations of means for performing the specified functions, combinations of steps for performing the specified functions and program instruction means for performing the specified functions. It will also be understood that one or more blocks or steps of the flowcharts, and combinations of blocks or steps in the flowcharts, can be implemented by special purpose hardware-based computer systems which perform the specified functions or steps, or combinations of special purpose hardware and computer instructions.

In this regard, one embodiment of a method of providing beat and tatum times, as shown in FIG. 20, includes employing downsampling to preprocess an input audio signal at operation 200. An initial operation of resampling may be included in the downsampling. The downsampling may be performed using, for example, a decimating sub-band filter bank such as a QMF filter bank. Accents may be extracted from the input audio signal during the downsampling. At operation 210, a periodicity and period based on the downsampled signal are determined. The periodicity of the downsampled signal may be determined, for example, using a DCT transform, a CZT transform, or other transformation function. In an exemplary embodiment, the beat and tatum periods may be determined based on periodicity information. At operation 220, phase estimation may be performed. The phase estimation may be accomplished using a pair of comb filters or other selectively chosen number of comb filters, as opposed to a bank of comb filters. In an exemplary embodiment, the phase estimation may be based on a weighted sum of accent information and period information. Accordingly, both beat and tatum times may be produced from corresponding beat and tatum periods. However, the phase may be common between both beat and tatum information.

The above described functions may be carried out in many ways. For example, any suitable means for carrying out each of the functions described above may be employed to carry out embodiments of the invention. In one embodiment, all or a portion of the elements of the invention generally operate under control of a computer program product. The computer program product for performing the methods of embodiments of the invention includes a computer-readable storage medium, such as the non-volatile storage medium, and computer-readable program code portions, such as a series of computer instructions, embodied in the computer-readable storage medium.

Many modifications and other embodiments of the inventions set forth herein will come to mind to one skilled in the art to which these embodiments pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method comprising:

employing downsampling to preprocess an input audio signal;

determining a periodicity and period based on the downsampled signal;

performing, via a processor, a phase estimation based on the period to determine a score comprising an average of filter outputs at intervals defined by the period; and determining beat information based on the period and the score associated with the phase estimation.

2. A method according to claim 1, further comprising an initial operation of resampling the input audio signal.

3. A method according to claim 1, wherein employing downsampling comprises performing a data reduction using a decimating sub-band filter bank.

4. A method according to claim 1, wherein employing downsampling comprises performing a data reduction using a quadrature mirror filter.

5. A method according to claim 1, wherein determining the periodicity comprises transforming a signal derived from the input audio signal using a discrete cosine transform.

6. A method according to claim 1, wherein determining the period comprises determining the period based on the periodicity.

7. A method according to claim 1, wherein performing the phase estimation comprises selectively employing comb filters to filter accent information.

8. A method according to claim 7, wherein performing the phase estimation comprises performing the phase estimation based on the accent information and the period.

9. A method according to claim 1, wherein employing downsampling further comprises extracting accent information from the input audio signal.

10. A method according to claim 1, wherein determining the periodicity comprises transforming a signal derived from the input audio signal using a chirp z-transform.

11. A method according to claim 1, further comprising calculating one of beat times or tatum times based on corresponding one of beat period information or tatum period information.

12. A computer program product comprising at least one computer-readable storage medium having computer-readable program code portions stored therein, the computer-readable program code portions comprising:

a first executable portion for employing downsampling to preprocess an input audio signal;

a second executable portion for determining a periodicity and period based on the downsampled signal;

a third executable portion for performing a phase estimation based on the period to determine a score comprising an average of filter outputs at intervals defined by the period; and a fourth executable portion for determining beat information based on the period and the score associated with the phase estimation.

13. A computer program product according to claim 12, further comprising a fifth executable portion for an initial operation of resampling the input audio signal.

14. A computer program product according to claim 12, wherein the first executable portion includes instructions for performing a data reduction using a decimating sub-band filter bank.

15. A computer program product according to claim 12, wherein the first executable portion includes instructions for performing a data reduction using a quadrature mirror filter.

16. A computer program product according to claim 12, wherein the second executable portion includes instructions for transforming a signal derived from the input audio signal using one of a discrete cosine transform or a chirp z-transform.

17. A computer program product according to claim 12, wherein the second executable portion includes instructions for determining the period based on the periodicity.

18. A computer program product according to claim 12, wherein the third executable portion includes instructions for selectively employing comb filters to filter accent information.

19. A computer program product according to claim 18, wherein the third executable portion includes instructions for performing the phase estimation based on the accent information and the period.

20. A computer program product according to claim 12, wherein the first executable portion includes instructions for employing downsampling further comprises extracting accent information from the input audio signal.

21. A computer program product according to claim 12, further comprising a fifth executable portion for calculating one of beat times or tatum times based on corresponding one of beat period information or tatum period information.

22. An apparatus comprising:

an accent filter bank configured to downsample an input audio signal;

a periodicity estimator configured to determine a periodicity based on the downsampled signal;

a period estimator configured to determine a period based on the periodicity; and a phase estimator configured to estimate a phase based on the period to determine a score comprising an average of filter outputs at intervals defined by the period for determining beat and tatum times of the input audio signal based on the period and the score associated with the phase estimation.

23. An apparatus according to claim 22, further comprising a resampler configured to resample the input audio signal.

24. An apparatus according to claim 22, wherein the accent filter bank comprises a decimating sub-band filter bank.

25. An apparatus according to claim 22, wherein the accent filter bank comprises a quadrature mirror filter.

26. An apparatus according to claim 22, wherein the accent filter bank comprises a power estimation element.

27. An apparatus according to claim 22, wherein the accent filter bank comprises an accent computation element.

28. An apparatus according to claim 27, wherein the accent computation element is configured to extract accent information from the input audio signal.

29. An apparatus according to claim 28, wherein the phase estimator includes a selectively determined number of comb filters configured to filter the accent information.

30. An apparatus according to claim 28, wherein the phase estimator is configured to perform the phase estimation based on the accent information and the period.

31. An apparatus according to claim 22, wherein the periodicity estimator is configured to transform a signal derived from the input audio signal using one of a discrete cosine transform or a chirp z-transform.

32. An apparatus according to claim 22, wherein the period estimator is configured to determine the period based on the periodicity.

33. An apparatus according to claim 22, wherein the apparatus is embodied in a mobile terminal.

34. An apparatus according to claim 22, wherein the phase estimator is configured to calculate one of beat times or tatum times based on corresponding one of beat period information or tatum period information.

35. An apparatus comprising:

means for employing downsampling to preprocess an input audio signal;

means for determining a periodicity and period based on the downsampled signal;

means for performing a phase estimation based on the period to determine a score comprising an average of filter outputs at intervals defined by the period; and means for determining beat information based on the period and the score associated with the phase estimation.

36. An apparatus comprising a processor configured to:

employ downsampling to preprocess an input audio signal;

determine a periodicity and period based on the downsampled signal;

perform a phase estimation based on the period to determine a score comprising an average of filter outputs at intervals defined by the period; and determine beat information based on the period and the score associated with the phase estimation.

* * * * *

UNITED STATES PATENT AND TRADEMARK OFFICE

CERTIFICATE OF CORRECTION

PATENT NO. : 7,612,275 B2
APPLICATION NO. : 11/405890
DATED : November 3, 2009
INVENTOR(S) : Seppänen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 524 days.

Signed and Sealed this

Nineteenth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,612,275 B2
APPLICATION NO. : 11/405890
DATED : November 3, 2009
INVENTOR(S) : Seppänen et al.

It is certified that error appears in the above-identified patent and that said Letters Patent is hereby corrected as shown below:

Column 14,
Line 23, "accent signals 10" should read --accent signals 110--;
Lines 43 and 44, "a[l], 0≦1≦N-1," should read --$a[\ell]$, $0 \leq \ell \leq N-1$,--.

Column 15,
Lines 18 and 19, "l=0, l=p (pairs of nearest peaks), l=2p (second-nearest peaks), l=3p" should read --$\ell = 0$, $\ell = p$ (pairs of nearest peaks), $\ell = 2p$ (second-nearest peaks), $\ell = 3p$--.

Column 20,
Lines 29-32, the sentence should read --According to an exemplary embodiment, the parameters include a delay τ which may be set equal to the current beat period estimate $\hat{\tau}_B$, and a feedback gain $\alpha_\tau = 0.5^{\tau/T_0}$.--.

Column 21,
Line 24, "$\tau_3 = 0.1$" should read --$\sigma_3 = 0.1$--.

Signed and Sealed this
Fifth Day of April, 2011

David J. Kappos
*Director of the United States Patent and Trademark Office*